US005592791A

United States Patent [19]

D'Annunzio et al.

[11] Patent Number: 5,592,791

[45] Date of Patent: Jan. 14, 1997

[54] ACTIVE CONTROLLER FOR THE ATTENUATION OF MECHANICAL VIBRATIONS

[75] Inventors: Camille M. D'Annunzio, Gaithersburg, Md.; Charles E. Chassaing, Raleigh, N.C.

[73] Assignee: Radix Sytems, Inc., Rockville, Md.

[21] Appl. No.: 450,678

[22] Filed: May 24, 1995

[51] Int. Cl.[6] ..... E04B 1/98

[52] U.S. Cl. ..... 52/167.2; 52/1

[58] Field of Search ..... 52/167.2, 167.1, 52/1

[56] References Cited

U.S. PATENT DOCUMENTS

| | | |
|---|---|---|
| 4,429,496 | 2/1984 | Masir . |
| 4,473,906 | 9/1984 | Warnaka et al. . |
| 4,635,892 | 1/1987 | Baker . |
| 4,745,553 | 5/1988 | Raven et al. . |
| 4,766,706 | 8/1988 | Caspe . |
| 4,783,937 | 11/1988 | Sato . |
| 4,799,339 | 1/1989 | Kobori et al. . |
| 4,841,685 | 6/1989 | Masri et al. . |

(List continued on next page.)

FOREIGN PATENT DOCUMENTS

| | | | |
|---|---|---|---|
| 164520 | 8/1985 | Japan | 52/167.2 |
| 275867 | 11/1989 | Japan | 52/1 |
| 275869 | 11/1989 | Japan | 52/167.2 |
| 43472 | 2/1990 | Japan | 52/167.2 |
| 47478 | 2/1990 | Japan | 52/167.2 |
| 49875 | 2/1990 | Japan | 52/167.2 |
| 240340 | 9/1990 | Japan | 52/167.2 |
| 55577 | 2/1992 | Japan | 52/167.2 |
| 341630 | 11/1992 | Japan | 52/167.2 |
| 52061 | 3/1993 | Japan | 52/1 |
| 231040 | 9/1993 | Japan | 52/167.2 |
| 231036 | 9/1993 | Japan | 52/167.2 |
| 231037 | 9/1993 | Japan | 52/167.2 |
| 231038 | 9/1993 | Japan | 52/167.2 |
| 231039 | 9/1993 | Japan | 52/167.2 |
| 307122 | 11/1994 | Japan | 52/1 |
| 2224097 | 4/1990 | United Kingdom | 52/167.2 |

OTHER PUBLICATIONS

Dirk T. M. Slock, "The Block Underdetermined Covarian (BUC) Fast Transversal Filter (FTF) Algorithm for Adaptive Filtering," *Proceedings of the 26th Asilomar Conference on Signals, Systems and Computers* (1992).

L. J. Erikkson, J. Acoust. Soc. Am., vol. 89, No. 1, "Development of the filtered–U algorithm for active noice control," pp. 257–265 (Jan. 1991).

I. Nishimura et al., "An Experimental Study of the Active Control of A Building Model", (Nov. 1990), pp. 64–83.

J. C. Burgess, J. Acoust. Soc. Am. vol. 70, No. 3, "Active adaptive sound control in a duct: A computer simulation," pp. 715–726 (Sep. 1981).

B. Widrow et al., Adaptive Signal Processing, pp. 97–140 and 195–230, Prentice Hall (1985).

*Primary Examiner*—Wynn E. Wood
*Assistant Examiner*—Aimee E. McTigue
*Attorney, Agent, or Firm*—Jacobson, Price, Holman & Stern, PLLC

[57] ABSTRACT

A plural orthogonal feed forward control system with an actuator system for installation on an upper floor or area of a building as an integral part of a building's structural supports to control seismic, wind, or wave disturbances to the structure or building. Control means include upstream and dual orthogonal downstream sensor arrays for determination of input and output error signals, plural orthogonal anti-feedback filters, and the plural adaptive weight updates to best determine the orthogonal components of the cancellation signal. The cancellation signal is acted on by the variable controlling force apparatus consisting of hydraulic or other actuators with stiff rods attached to the building structure and connected with a movable mass. The device works on orthogonal components of the disturbance, and is capable of attenuating simultaneously signals whose spectra contain multiple narrowband and/or combined narrowband and broadband character.

24 Claims, 15 Drawing Sheets

U.S. PATENT DOCUMENTS 4,922,667 5/1990 Kobori et al. .
4,956,947 9/1990 Middleton .
5,022,201 6/1991 Kobori et al. ..... 52/167.2
5,025,599 6/1991 Ishii et al. .
5,036,633 8/1991 Kobori et al. .
5,046,290 9/1991 Ishit et al. ..... 52/167.2 X
5,107,634 4/1992 Onoda et al. .
5,224,168 6/1993 Martinez et al. .
5,233,797 8/1993 Uno et al. .
5,239,789 8/1993 Uno et al. .
5,245,807 9/1993 Ishimaru et al. .
5,255,764 10/1993 Kurabayashi .
5,311,709 5/1994 Kobori et al. .
5,321,923 6/1994 Oda .
5,325,437 6/1994 Doi et al. .
5,337,365 8/1994 Hamabe et al. .
5,355,417 10/1994 Burdisso et al. .
5,363,451 11/1994 Martinez et al. .
5,377,275 12/1994 Suzuki .
5,377,276 12/1994 Terai et al. .
5,382,134 1/1995 Pla et al. .
5,398,462 3/1995 Berlin et al. ..... 52/1
5,410,605 4/1995 Sawada et al. .
5,410,845 5/1995 Sakamoto et al. .
5,414,775 5/1995 Scribner et al. .

ACTIVE CONTROLLER FOR THE ATTENUATION OF MECHANICAL VIBRATIONS

BACKGROUND OF THE INVENTION

1. Field of the Invention

The invention relates to an active control system for protecting a structure, such as a building, from disturbances, such as vibrational disturbances, by imparting canceling forces to the structure. More particularly, it relates to a plural orthogonal controlling force apparatus, having a corresponding number of plural time domain digital controllers, with input and output sensor arrays which work on orthogonal components of the disturbance. The apparatus is capable of attenuating simultaneously signals with spectra consisting of multiple narrowband character, or combined narrowband and broadband character. The invention has particular applicability to controlling or counteracting seismic or other environmentally induced disturbances.

2. Description of Related Art

Vibration control systems for attenuating undesirable wind, earthquake and mechanical vibrations are known. Many of these prior vibration control systems are passive systems such as the base isolation and the dynamic absorber type control systems that are commonly used to attenuate unwanted vibrations. Patents relating to various techniques for wind and earthquake disturbance control include U.S. Pat. Nos. 4,783,937; 4,799,339; 4,841,685; 4,429,496; 4,635,892; 4,922,667; 4,956,947; 4,766,706; 5,025,599; 5,036,633; 5,107,634; 5,233,797; 5,239,789; 5,245,807; 5,255,764; and 5,311,709. However, because the character of the undesired vibrations may change over time, active vibration control may provide better attenuation abilities than passive systems. A combination of active and passive methods may provide the best protection against unwanted vibrations, particularly from earthquakes.

A known prior art controller for wind and earthquake disturbances by Nishimura (Nishimura, Isao et al., "An Experimental Study of the Active Control of a Building Model," *Proceedings of the First Joint U.S./Japan Conference on Adaptive Structures,* Maui, Hawaii, Nov. 13–15, 1990) is depicted in FIG. 1. It is based on feedback analysis. This system does not have an upstream sensor array to measure the disturbance signal, $x_k$, before the disturbance enters the structure; all responses are measured by the downstream sensors to give the output or error $e_k$. The error signal $e_k$ is fed into an analysis box to give the cancellation signal $u_k$ which is imparted to the system by an actuator. It is a closed loop controller. The control law is a linear feedback control system based on the first order differential equation model of the system. This control system requires development of a good model for the building or structure before the controller is installed. State space based controllers have difficulty with time lags. If the time lag, between the time the disturbance is sensed and the time the correcting force is applied, is too long this type of controller does not work well.

A prior art controller for earthquake disturbances by Kobori et. al. (U.S. Pat. No. 4,799,339) is shown in FIG. 2. This controller is a feed forward frequency domain controller 10" based on a single frequency with upstream sensors 4" near the building and close to the source of the seismic disturbance. (In addition to the feed forward controller, a feedback controller to modify the rigidity of the building by stiffness connectors 5 is also incorporated.) The downstream sensors 6" are on the building 2". Though this is a feed forward controller it is significantly different than the present invention since it is not only frequency domain based but also limited to a single frequency. This system has two upstream sensor sites 4"; one at the epicenter 4"A of the earthquake and the second consisting of two sensors in the ground near the building 4"B. This assumes that the network of seismic monitoring sites is extensive so that any earthquake epicenter will be monitored by a nearby sensor. This may be feasible in Japan or California but may be difficult elsewhere. The schematic shows the sensors 6" within the building 2" and the controller 10". In addition, this system strives to change the rigidity to reduce the vibration of the building as well as control the excess disturbance. The addition of the rigidity modifications 5" then changes the transfer functions of the controller with time making this a very difficult control problem. The patent description of this prior art does not discuss the details of the controller other than to say that it "analyzes frequency characteristics and calculatively forecasts the oscillatory property" (U.S. Pat. No. 4,799,339, column 5, lines 57–58).

Other control systems of the digital feed forward type are also known in the art. Much of the early work in digital feed forward control systems occurred in the acoustic field arena for noise attenuation in a fan duct using a speaker to introduce the canceling sound wave. Prior control systems for acoustic systems use adaptive filtering based on the Least Mean Square (LMS) algorithm in various configurations to estimate the required cancellation signal to be introduced into the system. Examples of these techniques include U.S. Pat. Nos. 5,337,365; 5,325,437; 5,355,417; 5,377,275; and 5,377,276. Prior control systems based on the LMS will adapt successfully for strictly broadband or narrowband characteristic input signals but, if the input signal spectrum consists of a broadband signal and a narrowband signal or of multiple close tones, the filter output may not converge, or, at best, converge extremely slowly. This is true because, when the condition number of the input correlation matrix is large, the LMS will not converge. Since many mechanical systems have multi-tonal input signals, this type of controller is not generally applicable.

Input signals with both broadband and narrowband characteristics in the frequency domain will be referred to as combined input. An example of combined input consists of colored noise (broadband) and multiple tonals (narrowband). Thus, prior control systems with the adaptive LMS filter may be used effectively and efficiently only in systems with input signals that have a strictly broadband or narrowband spectrum where the tones are well separated. In addition, prior control systems also have difficulty converging for narrowband signals consisting of multiple tones. A significant drawback of control systems with the LMS as the adaptive filter is their inability to converge rapidly (within k*n filter lengths, k<10) for combined input. The convergence time may be such that the necessary action by the compensator or actuator to cancel the noise or vibration is applied too late and thus, instead of reducing the vibration, the problem becomes exacerbated.

FIG. 3 shows a known prior art filtered-X controller system developed by Burgess (Burgess, J. C., "Active adaptive sound control in a duct: A computer simulation," *J. Acoust. Soc. Am.,* 70(3), Sep. 1981, pp. 715–726). This controller is designed for use with a Finite Impulse Response (FIR) filter adapted in the time domain using the LMS algorithm. This controller includes upstream 4' and downstream 6' sensors feeding into the controller 10'. The disturbance is sensed at the upstream sensor array 4' and then enters the object 2' generating the unwanted response. The canceling signal is added 8' and then the resulting output or error signal is sensed by the downstream sensor array 6'. $P_1$ represents the transfer function between the upstream 4' and downstream 6' sensors. $P_2$ represents the transfer function between the canceling force device and the downstream sensors. $\hat{P}_2$ represents an estimate of $P_2$. The output error signal $e_k$ is fed into the LMS controller algorithm 20'B along with $v_k$ (the disturbance signal $x_k$ filtered by the estimate of $P_2$ gives $v_k$). The LMS algorithm determines the weights or coefficients which give the best canceling signal. These weights are then used to filter 20'A the disturbance signal to give $q_k$. The signal, $q_k$, is then applied to the object through the actuator array which is represented by $P_2$ 16' to give the cancellation signal $\hat{y}_k$. This controller does not have an anti-feedback filter so it has difficulty with non-ideal systems where there is contamination of the upstream sensor by the canceling signal. This controller works well for an ideal system if the input signal's spectrum consists of a single tone or of strictly white noise of broadband character. Because this control configuration is based on the LMS algorithm, as discussed above, it does not perform well for the combined problem or for the multiple tone problem.

Many practical systems experience the combined input such as tones in colored noise. This is frequently true in structural control. A stable control system which will handle combined input is necessary for structural vibration attenuation. Prior stable FIR systems adapt too slowly to actively control the physical system to reduce the vibrations of the system when the input consists of combined narrowband (tonals) and broadband spectrum signals. Thus, there is a need for a stable control system that can adapt rapidly for all types of input but, in particular, for the combined broadband/narrowband problem or the multiple tonal case.

In active adaptive filters such as those of Burgess discussed above and depicted in FIG. 3, to control unwanted signals there must be a canceling signal that is summed with the input signal to attenuate the input signal as it traverses the object to be controlled. The input and output signals must be measured by appropriately located sensors and the canceling signal must be generated by actuators and propagated into the structure. The structure to be controlled, and the sensors and actuators constitute the physical system. The physical system can be thought of as a number of "plants" interacting to produce the output. A "plant" is defined to be the transfer function between two nodes such as between the input and output sensor arrays, such terminology being well known in the art. The digital controller or electrical system consists of estimates of plant models, other filters and the adaptive algorithm that determines the cancellation signal.

The general goal of such control systems is to control the motion of the structure by minimizing the error signal. The canceling signal device is adapted by the system controller which may consist of various plant model estimates, a system model, and an adaptive algorithm in a specific controller configuration.

The present invention is based on the well-known concept of Finite Impulse Response (FIR) filters in the time domain. As such, only time domain FIR based methods will be discussed in detail. A FIR filter model, as is known, consists of a set of N+1 weights which represent a plant such that when convolved with the input data, produce an estimate to the actual plant output. A FIR filter is also referred to as an all zero filter because it requires only data entering the plant, x, and not output data, y. If we let $b^k \equiv \{b_0^k \ldots b_N^k\}$ be the set of N+1 filter weights at time k, and let $x_k$ be the input value at time k, and $y_k$ be the output value at time k, then the output at time k may be written as a linear combination of the filter weights with the past input values:

$$y_k = b_0^k x_k + b_1^k x_{k-1} + \ldots + b_N^k x_{k-N}.$$

The vector b may be fixed for all time or it may be adapted in time by an adaptive filter algorithm. In the z-domain the transfer function may be written as $$H(z) = \frac{b_0 z + b_1 z^{-1} + \ldots + b_N z^{-N}}{1}.$$

It has a denominator of 1 indicating that no output values are required. It is called a finite impulse response filter (FIR) because when an impulse is applied to this system its response dies out in finite time. For a detailed explanation of the Z-domain and FIR filters, see Widrow & Stearns, *Adaptive Filter Processing,* Prentice Hall, 1985, Chapters 7 and 9 of this well-known text. Many times, in order to obtain a good approximation to the plant, N must be large. The value of N must be weighed in conjunction with the convergence rate of adaptive filter so that convergence is rapid enough for the system to be realizable.

The controller cannot control without a method to adjust the weights, b, which determine the canceling signal to be propagated into the system. The method of adjustment, the adaptive filter algorithm, is an integral part of any controller without which there can be no active control. The adaptive filter algorithm adjusts the weights at each time step based on some defined error criteria. The weights are adapted in time and will change at every time step until the adaptive filter algorithm has converged. If at a later time the input varies in time the weights will be adapted anew to match the new input characteristics. Adaptive algorithms that have been used in adaptive feed forward controllers include the Least Mean Square (LMS) and the LMS in normalized form (NLMS).

The LMS is a gradient descent method developed by Widrow (see Widrow & Stearns, Chapter 6). It uses a single past sample when adjusting the weights for the cancellation based on the error signal at the output sensor. It also has a scaling or acceleration parameter μ (also called the adaptive gain constant) that is determined by the user based on the problem of interest as is well known in the art (see, Widrow and Stearns, p. 111, Eq. 6.36). The LMS computes the weight update as:

$$e_k = y_k - \hat{y}_k$$

$$w_{k+1} = w_k + 2\mu e_k v_k$$

where the above variables and coefficients are as shown in FIG. 3. It requires O(N) computations per sample and performs well for problems where the input data correlation matrix, R, has a small condition number ($R = E[X^T X]$ where X is the input data vector). [O(N) is read as Order(N) and means that the number of operations required per time step is proportional to N. This can be written as K*N, where K is a constant.]

The NLMS algorithm, as is well known, is the LMS normalized by $\|v_k\|^2$. It computes the weight update as $$w_{k+1} = w_k + 2\mu \frac{e_k v_k}{\|v_k\|^2}.$$

The Block Underdetermined Covariance (BUC) algorithm was developed by Slock (Slock, D. T. M., "The Block Underdetermined Covariance (BUC) Fast Transversal Filter (FTF) Algorithm for Adaptive Filtering," *Proceedings of the 26th Asilomar Conference on Signals, Systems and Computers,* 1992, incorporated by reference herein). The BUC is a modified block least squares method which uses an L×L estimate to the N×N input correlation matrix and a sliding window. It requires $O(L^2)$ computations, where L may be relatively small compared to N. It also has a scaling parameter that is set by the user. Unlike the LMS, the BUC is relatively insensitive to the condition number of the input correlation matrix.

The objective of the BUC algorithm, which governs the operation of the transversal filter, is to obtain the filter weights in such a way as to minimize the error, e, and find the weighted sum of the input signals that best fits the desired response. This objective is similar to that of the LMS. However, the methods by which the two algorithms determine the filter coefficients and minimize the error differ markedly. In the LMS, changes in the weight vector to accomplish this end are made along the direction of the estimated gradient vector based on the method of steepest descent on the quadratic error surface. The LMS relies on a single past sample value to determine the estimate of the filter weights. The BUC uses multiple past sample values (equal to a small percentage of the number of weights) to determine the estimate of the filter weights by minimizing the least squares criterion.

The BUC algorithm uses a window length L that is shorter than the FIR filter order N, leading to an underdetermined least squares problem to be solved. The BUC can treat successive blocks of data with no overlap or it can slide along the data advancing the block by as little as a single sample. A projection mechanism onto a subspace of dimension L renders the BUC's convergence less sensitive to the coloring of the input signal spectrum than is the case for the LMS algorithm. The underdetermined least squares character of the BUC also endows it with relatively fast tracking ability. In addition, the tracking ability of least squares type algorithms (such as the BUC) is independent of the condition number of the input correlation matrix.

The goal in selecting an adaptive filter algorithm for adjusting the filter weights is to enable fast convergence, without too many computational steps, and to produce the correct cancellation signal. When used as part of a feed forward controller, the LMS or NLMS algorithms converge quickly and accurately so long as the input signal is not a combined broadband and narrowband signal or is not a multiple tonal signal. With these latter inputs, the LMS/NLMS algorithm converges slower than the BUC, if it converges.

The BUC algorithm has not, to the applicant's knowledge, been used as an adaptive filter algorithm in a controller system. The BUC is expected to be slower than the LMS algorithm since it generally requires more computations per time step.

SUMMARY OF THE INVENTION

The present invention is an adaptive feed forward control system for reducing or attenuating disturbances acting upon or within a physical structure, such as a building. The invention includes sensors to sense or detect the disturbances and a method to then separate such sensed disturbances into orthogonal signal components. Plural orthogonal feed forward controllers, corresponding in number to the number of orthogonal components, impart cancellation forces, through orthogonally oriented actuators, to the structure to cancel the undesired disturbances.

The plural orthogonal feed forward control system of the present invention has particular applicability for attenuating a vibration field in a building structure resulting from externally applied seismic or other environmentally induced disturbances, such as earthquakes or high wind disturbances. The vibration field induced by these external disturbances is defined as the input vibration field. As is well known, earthquake ground waves produce vibrations within a structure that may cause substantial damage. Earthquake energy propagates through the earth as compressional and shear waves which impart energy to structures in the form of compressional, shear and bending waves. Bending waves are generally the most destructive. The energy of the earthquake imparted to the building is filtered by the building resonances (mostly by the first three major resonance frequencies). The spectrum of the signal propagating through the structure may consist of narrowband and/or broadband character.

Structures such as oil rigs in the ocean face disturbances similar to that for building structures during earthquakes. The wave motion of the water causes the platform to sway introducing shear and bending waves into the structure. This problem can be formulated exactly as that of control of a structure during an earthquake.

The present invention provides for plural orthogonal feed forward controllers, for example, dual orthogonal controllers, for driving dual orthogonal actuators for imparting a vibration field to the building structure so as to counteract the primary vibration field on the structure resulting from earthquakes or high wind conditions. This counteracting vibration field is defined as the cancellation vibration field. A movable mass is situated at an upper level of the building, such as a central chamber within the building located at one of the top-most floors. Actuators connected between the movable mass and the structural supports of the building move the movable mass so as to counteract or cancel the vibrations induced by the input vibration field.

To reduce the complexity of a controller, orthogonalization of the input and output will simplify the design. For rigid body motion, three translational displacements or their derivatives can be sensed and three rotational displacements or their derivatives can be sensed. Total control of the motion of a rigid body requires six independent (i.e., orthogonal) channels. If the channels are not independent (i.e., not orthogonal) then 36 channels could be required. Non-rigid body motion can be orthogonalized by sensing and controlling patterns of vibration which are orthogonal to one another. Those patterns of motion may or may not correspond to the modes of vibration of a structure. Complete orthogonalization is not required to improve the performance of a controller. The separation of the sensed disturbances into orthogonal components, the provision of separate orthogonal controllers responsive to such components, and the providing of orthogonal outputs to control orthogonally oriented actuators provides many advantages. For example, it reduces the number of channels required simplifying the controller configuration. Also, orthogonality reduces the condition number (due to spatial effects) of the problem making the problem easier to solve. If full orthogonalization is not possible, partial orthogonalization may be used simplifying the controller to a lesser extent.

The present invention is also directed to an adaptive feed forward control system for counteracting undesirable disturbances by applying cancellation signals to a physical structure or system, whereby the adaptive feed forward controller adjusts the adaptive filter weights in accordance with the BUC algorithm. The BUC algorithm has several advantages previously unrecognized in the controller art. Specifically, the BUC algorithm may be successfully employed where the input signal spectrum is of combined broadband and narrowband character or of multiple narrowband character (multiple tones). These combined type signal spectra are found to exist in earthquake seismic signals. Moreover, despite the increase in the number of computations required per time step for the BUC algorithm as compared to the LMS algorithm, it has been discovered that the parameter L of the BUC, which determines the L×L estimate of the input correlation matrix, is smaller than expected for success. Thus, the total number of computations required for a solution within a given tolerance may not be substantially greater than for the LMS.

Accordingly, it is an object of the present invention to provide a feed forward control system for reducing disturbances, such as vibrational disturbances, acting upon a structure using plural orthogonal controllers, preferably dual orthogonal controllers. It is a further object of this invention for utilizing such plural controllers to counteract earthquake or other environmental disturbances, such as high wind disturbances. Still further, it is an object of the present invention to control or counteract disturbances of both broadband and narrowband character, or multiple narrowband character, by using an adaptive filter employing the BUC algorithm.

DETAILED DESCRIPTION OF PREFERRED EMBODIMENTS

Figure 1:
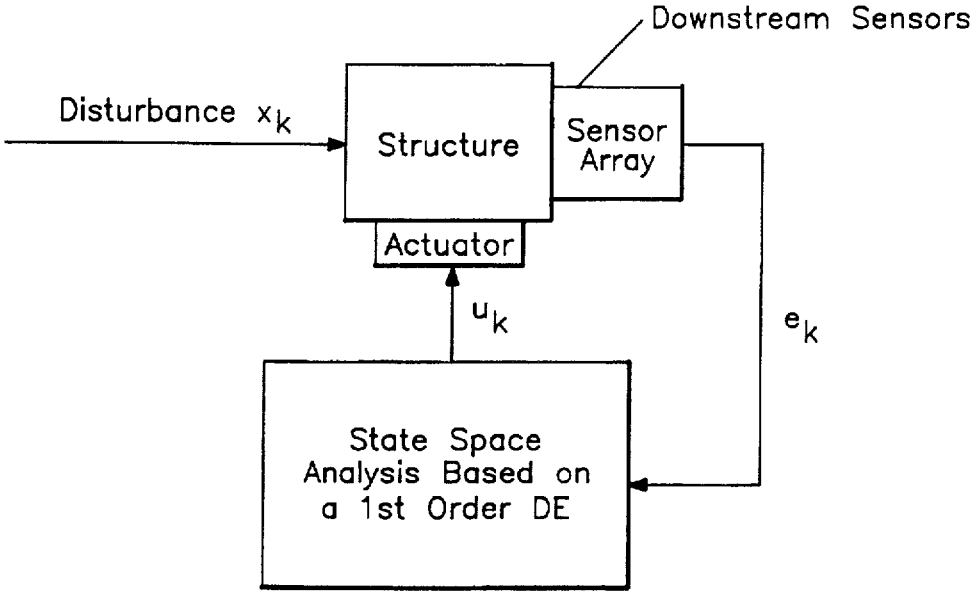
FIG. 1 (PRIOR ART)
FIG. 1 is a block diagram of a prior art closed loop feedback controller for attenuating the vibrational response of a building to an earthquake.
Figure 2:
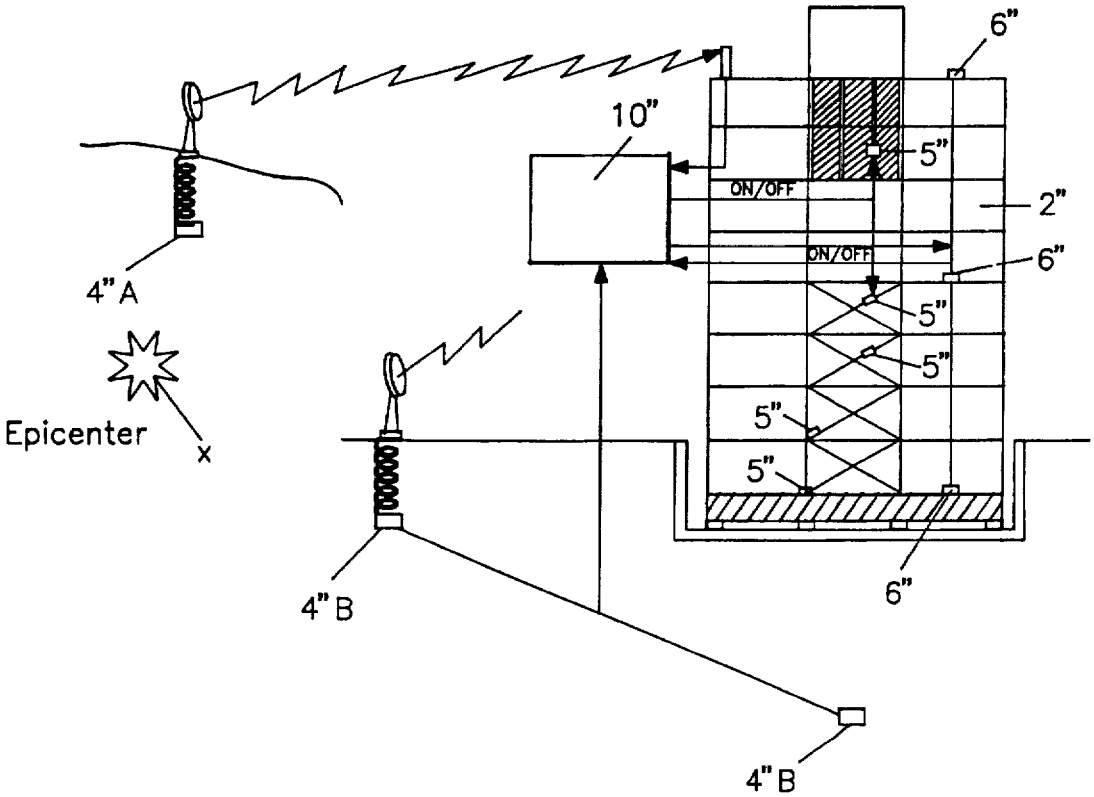
FIG. 2 (PRIOR ART)
FIG. 2 is a schematic of a prior art active frequency domain feed forward prediction controller for attenuating a building's vibrational response to an earthquake.
Figure 3:
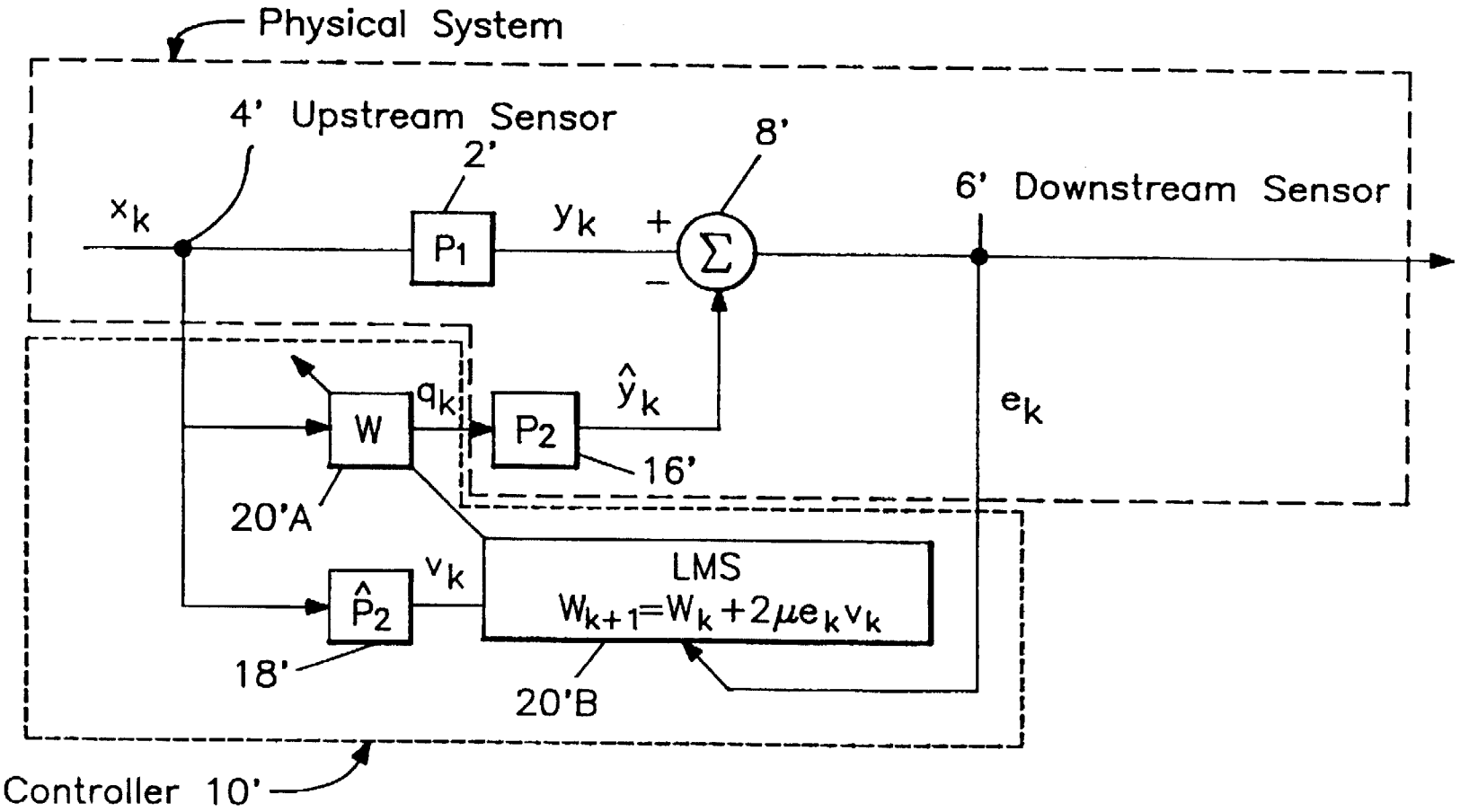
FIG. 3 (PRIOR ART)
FIG. 3 is a schematic of the prior art Burgess Filtered-X LMS based controller for acoustic systems.
Figure 4:
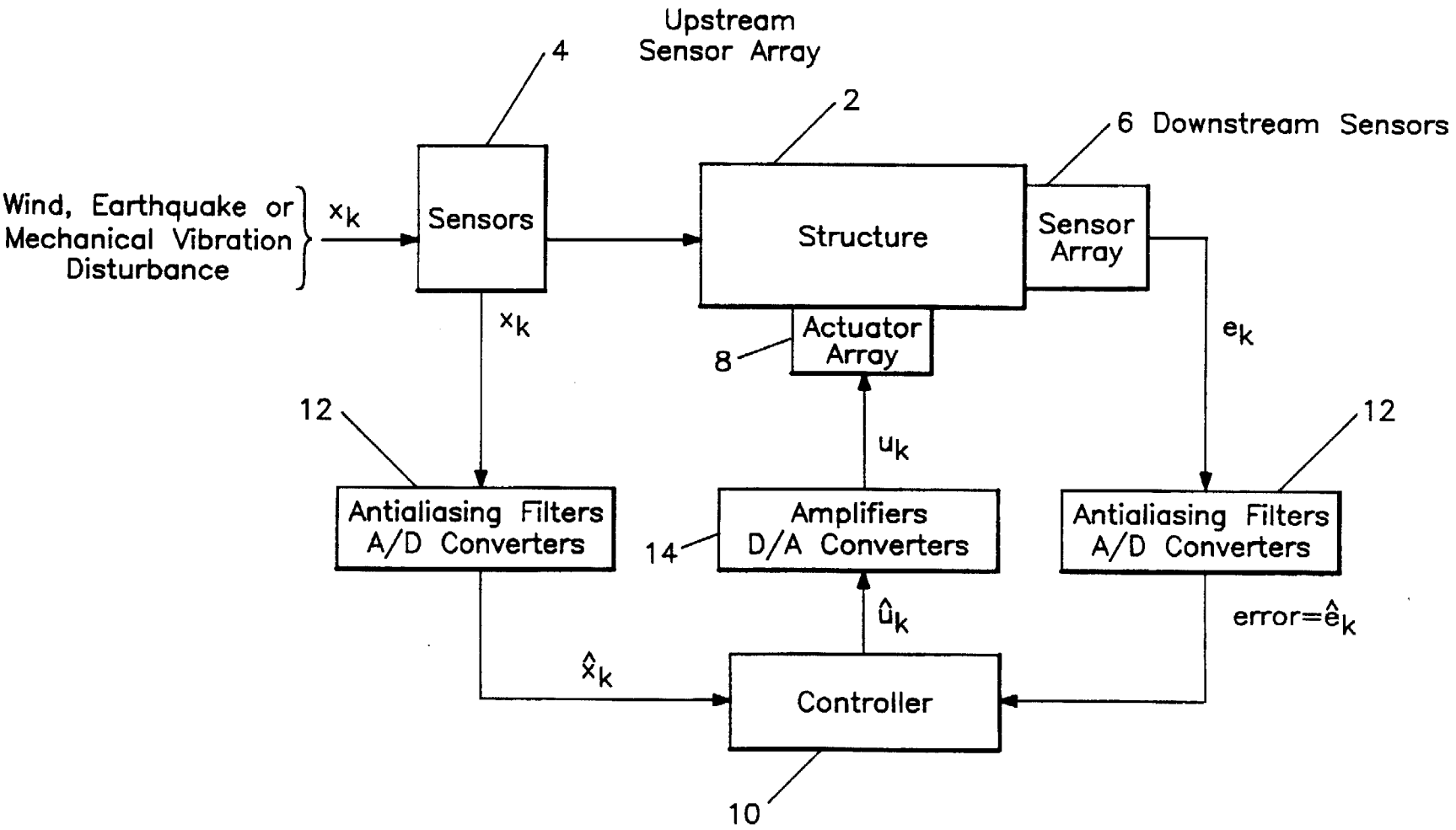
FIG. 4 is a generalized feed forward control diagram for a building or mechanical structure system.

A generalized schematic of an active feed forward controller system is depicted in FIG. 4. The vibrational disturbance $x_k$, such as an earthquake, wind, or other disturbance that may induce undesirable vibrations is measured at an upstream vibrational sensor array 4. The disturbance passes through the structure 2 to a second sensor array 6 within the structure to give the error or output signal. The error value, $e_k$, anti-aliased and digitized, $\hat{e}_k$ 12, is input into the controller 10 along with the anti-aliased and digitized disturbance signal, $\hat{x}_k$, 12. The controller 10 determines the best canceling signal $\hat{u}_k$ which is passed through a D/A converter and an amplifier 14 to give $u_k$ and then $u_k$ is applied to the mechanical or structural system by the shaker or actuator array 8 to attenuate the undesired vibrational response. As will be discussed, the upstream sensor array 4 senses the disturbance and provides an electrical input or reference signal which is then separated into orthogonal components. The controller 10 includes plural orthogonal controllers providing orthogonal canceling signals to orthogonally oriented actuators.

The present invention has applicability for any type structural vibration cancellation problem. Two examples, for earthquakes and wind disturbances, will be discussed in detail, however use of this invention is not limited to these specific types of problems.

A seismic disturbance to a building generates shear and bending waves within the building or structure which excite the vibrational modes of the building or structure. Similarly, an ocean wave disturbance to an ocean-based structure (such as an oil rig) also generates shear and bending waves within the structure which excite the vibrational modes of the structure. In each of these cases, the major excitation energy occurs in the first three modes of the structure and may cause the building or structure to sway side to side or front to back. The vibrational modes of a building or structure may be determined by experimental methods (driving the building with a force and measuring its modes) or by mathematically modeling the building or structure using a finite element model. (As used herein, the term "building" or "building structure" is meant to be generic to both buildings, such as high-rise office buildings or ocean-based structures, such as oil rigs, or any other type of structure that behaves similarly.)

The vibrational building modes are orthogonal to each other. This orthogonality can be used to assist in the placement of the downstream sensors and control actuators.

Figure 5A:
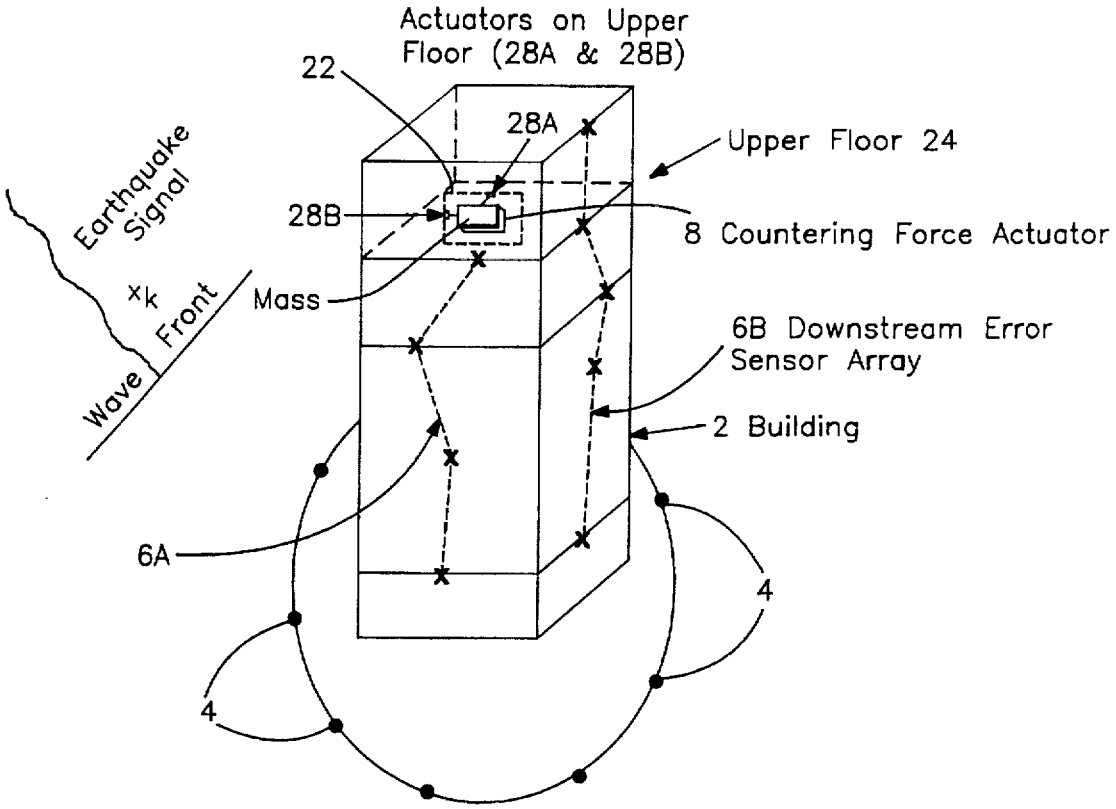
FIG. 5A is a schematic of a preferred embodiment for a seismic disturbance to a building in accordance with the invention.

As shown in FIG. 5A, a plurality of input sensors 4 are disposed around a building 2. These sensors 4 may include velocimeters, accelerometers, or displacement measuring devices which sense an incoming earthquake vibration and convert the sensed vibrational disturbance to an electrical input or reference signal. As will be discussed, the input signal is broken down into orthogonal components and provided to the controllers which control the actuator 8. The actuator 8 consists of two separately controlled actuators 28A,28B attached to orthogonal sides of a mass integrated into an upper floor of the building structure and to the main supports of the building so that the canceling forces can be applied directly to the main supports of the building. Two downstream arrays of sensors 6A,6B installed along orthogonal sides of the building must be placed such that they are not located at a node of the first three vibrational modes. Sensors located at a node will not sense the motion because of the null that occurs at a node. The number of sensors required will depend on the size and height of the building. The downstream sensor arrays, located in orthogonal planes of the building, provide an error or output signal to each of the controllers as will be described.

The upstream array of input sensors 4 are circularly located in the ground about the building. The number of upstream sensors required depends on the size of the base of the building. There must be a sufficient number of sensors in the ground-based upstream array to determine a good approximation of the direction of arrival of the seismic disturbance. The sensor that first detects the disturbance determines its direction of arrival. The signal from this sensor is used by the plural orthogonal controllers as their upstream input. Contamination of the upstream sensors by the controlling vibration, or cancellation vibration field, is not a concern for the seismic disturbance problem since the upstream array is in the ground away from the building. Thus, there is little or no feedback from the cancellation vibrations induced by the actuators that would reach the remote input sensors. The upstream sensor signal, along with the appropriate error signal from the downstream sensor array, is fed into the controller, as will be discussed, which determines the canceling signal. It is assumed that anyone skilled in the art of digital controllers understands that all signals to and from the controller would be anti-aliased and converted from analog to digital (A/D) or digital to analog (D/A) and amplified as appropriate and thus these steps are not further shown or discussed.

For a feed forward controller to operate in an optimum way it should not be predicting the disturbance waveform traveling through the ground. The upstream sensor array 4 must be far enough away from the structure 2 so the delay in propagation of the disturbance from the sensors 4 to the building is greater than the delay in processing the signal in the controller. The physical distance on the ground or media corresponds to the compressional velocity of sound for a structure on land, and the surface wave velocity for a structure in water, times the delay in signal processing within the digital signal processing chip within the controller. This delay is on the order of 3 samples for many systems with A/D and D/A converters with the controller algorithm in between. The velocity of sound in rock (which has the highest speed) is on the order of 15,000 ft/sec. The upper frequency limit of servo valves for hydraulic cylinders is on the order of 200 Hz, while most earthquake energy is below 30 Hz. A 500 Hz sample rate would be more than adequate, thus 3×1/500×15000=90 ft. Accordingly, the sensors in this example must be at least 90 ft away from the building or structure to ensure that the counteracting control vibrations are applied at or prior to the building's receipt of its input vibrations.

Figure 8:
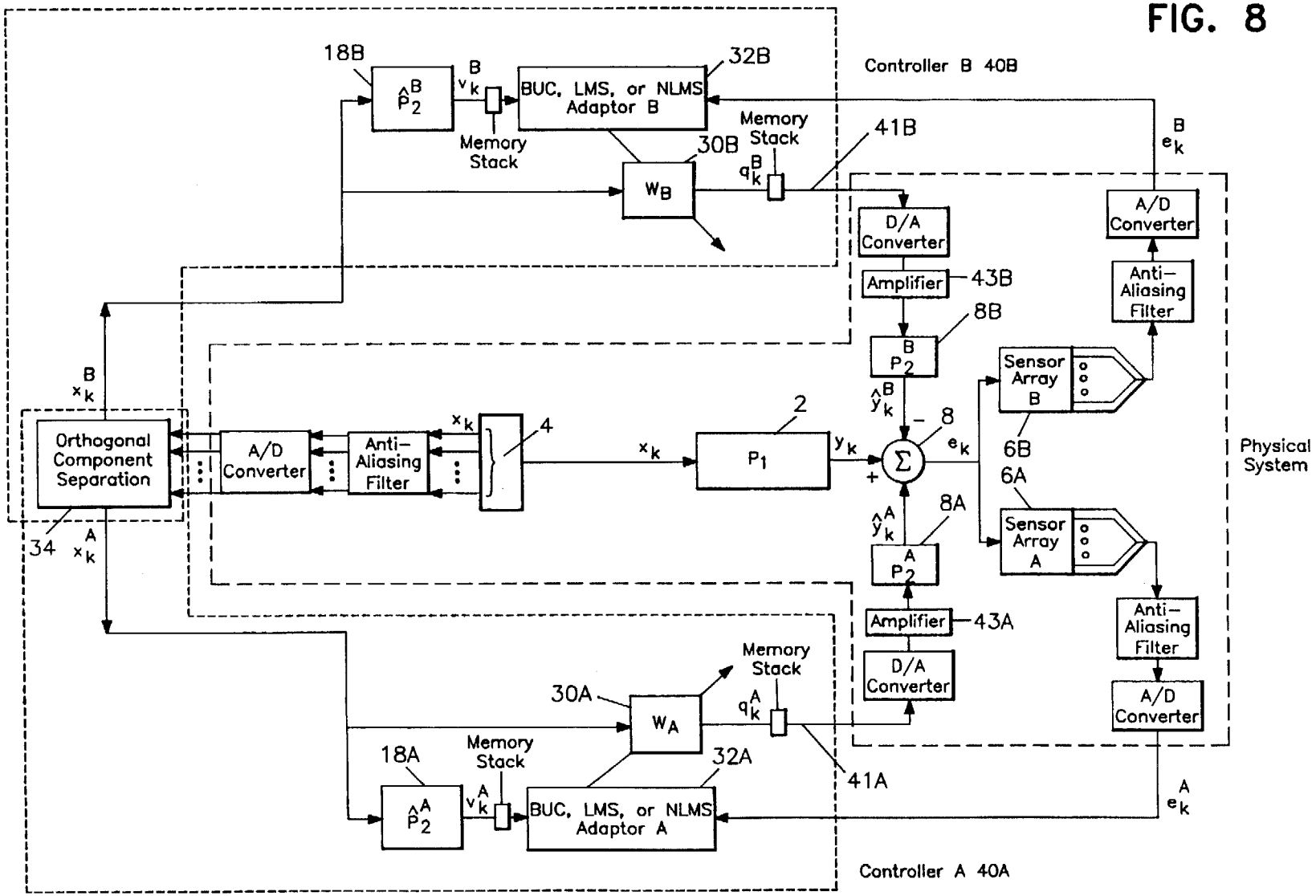
FIG. 8 is a block diagram of the preferred embodiment for the control system for a seismic disturbance in accordance with the invention.

As shown in FIG. 5A, the earthquake wave front approaches substantially tangentially to the circular sensor array 4. By detecting which of the sensors 4 is "hit" first, a determination can be made of the wave front direction with respect to the building and thus the input signal can be decomposed into its orthogonal components. The number of sensors around the building to determine source direction and the particular reference sensor, or signal channel to be used as the input signal source, should be 8 or greater (8 would give 45 degrees of resolution, 32 would give 11 degrees of resolution which would be better). The upstream sensors 4 located in the ground around the building 2 should be spaced close enough such that direction of arrival may be determined within a few degrees. The signals from the ring of sensors 4 around the building or structure, are sampled synchronously by a digital signal processor 34, as schematically shown in FIG. 8. These signals are continuously cross correlated to each other. The particular signal channel (sensor) which satisfies the following two criteria is used as the reference channel. The criteria are 1.) the signal level is above a minimum level and 2.) the signal has the lowest lag to the adjacent channels for peak cross correlation. Once the specific sensor, or reference channel is found, then the system is enabled, and the input to the dual orthogonal controller systems is generated, as will be described. Since the location of the sensor relative to the building is known, the wavefront can be decomposed into two orthogonal components or directions. These two orthogonal signals become the input or reference signals for the controllers.

The number of output or downstream sensors 6A,6B on each side of the building is determined by the first three mode shapes in each direction. The number of sensors must be sufficient so that spatial aliasing does not occur. It is expected that 6 sensors per side will be adequate (however, more would provide better resolution). The downstream sensor sets sense the movement of the structure to provide an error signal for use in the appropriate orthogonal controller. Each error signal used in an orthogonal controller is formed by combining the signal from each sensor in the set weighted by $\beta_i$ (i=1 to number of sensors) so that the maximum output of the sensors occurs for the first three vibrational modes of the building. For example, suppose there are 6 downstream sensors represented by 1 through 6. Each of these 6 sensors has a weight associated with it based on the model shape for each mode. This could be thought of as the sum of three vectors representing the appropriate weights $d_{1,j}$ through $d_{6,j}$ for each of the first j modes (j=1 to 3) with each vector weighted by the participation factor of the mode $\alpha_j$:

$$\begin{bmatrix} \beta_1 \\ \cdot \\ \cdot \\ \cdot \\ \beta_6 \end{bmatrix} = \alpha_1 \begin{bmatrix} d_{1,1} \\ \cdot \\ \cdot \\ \cdot \\ d_{6,1} \end{bmatrix} + \alpha_2 \begin{bmatrix} d_{1,2} \\ \cdot \\ \cdot \\ \cdot \\ d_{6,2} \end{bmatrix} + \alpha_3 \begin{bmatrix} d_{1,3} \\ \cdot \\ \cdot \\ \cdot \\ d_{6,3} \end{bmatrix}$$

where $\beta_j$=the weight for the $i^{th}$ sensor $d_{i,j}$=the $i^{th}$ weight for the $j^{th}$ mode $\alpha_j$=the participation factor for the $j^{th}$ mode.

The d weights are determined by the mode shape. The mode shapes for each set of sensors may differ especially if the building is not square. (A rectangular shaped building would be expected to have more flex in the shorter direction.) The d weights are normalized so the maximum value permitted is 1; these weights may also be orthogonalized. The α factor is determined based on the structure and the disturbance type. The first mode generally is the most important in that it has the most energy, more than the second which has more than the third. Recall that most of the energy from disturbances into the structure occurs at low frequency so that generally only the first three modes are important. There is very little energy in the higher frequencies thus, there is little interest in controlling the modes related to higher frequencies.

Figure 5B:
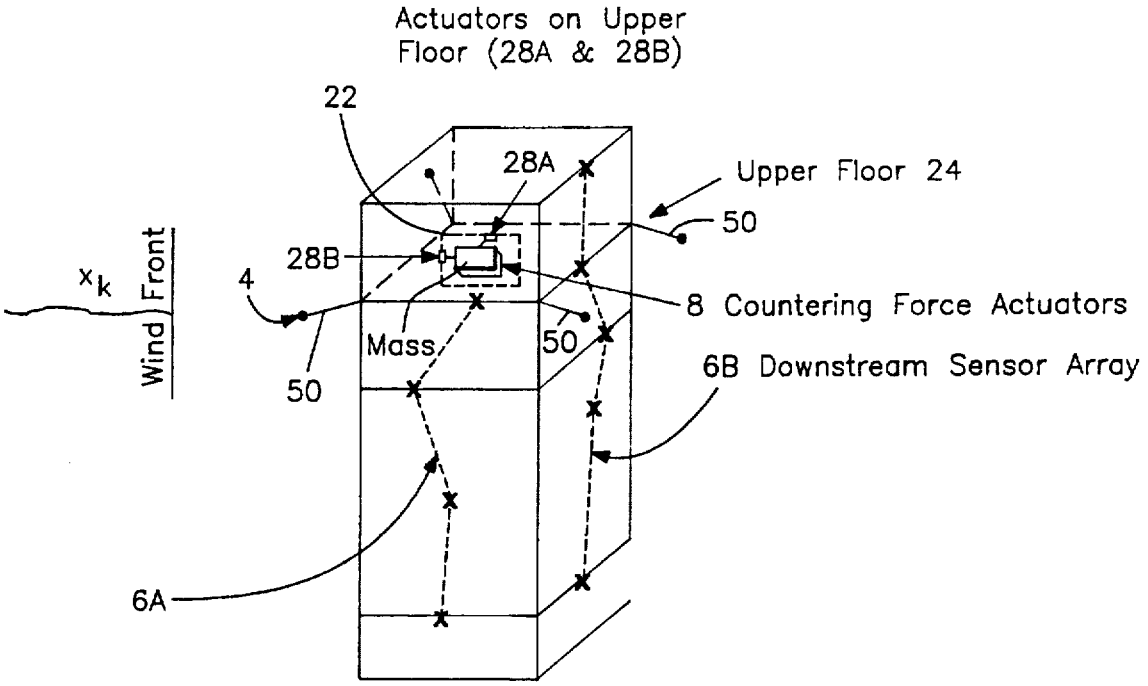
FIG. 5B is a schematic of the preferred embodiment for wind disturbances to a building in accordance with the invention.
Figure 9:
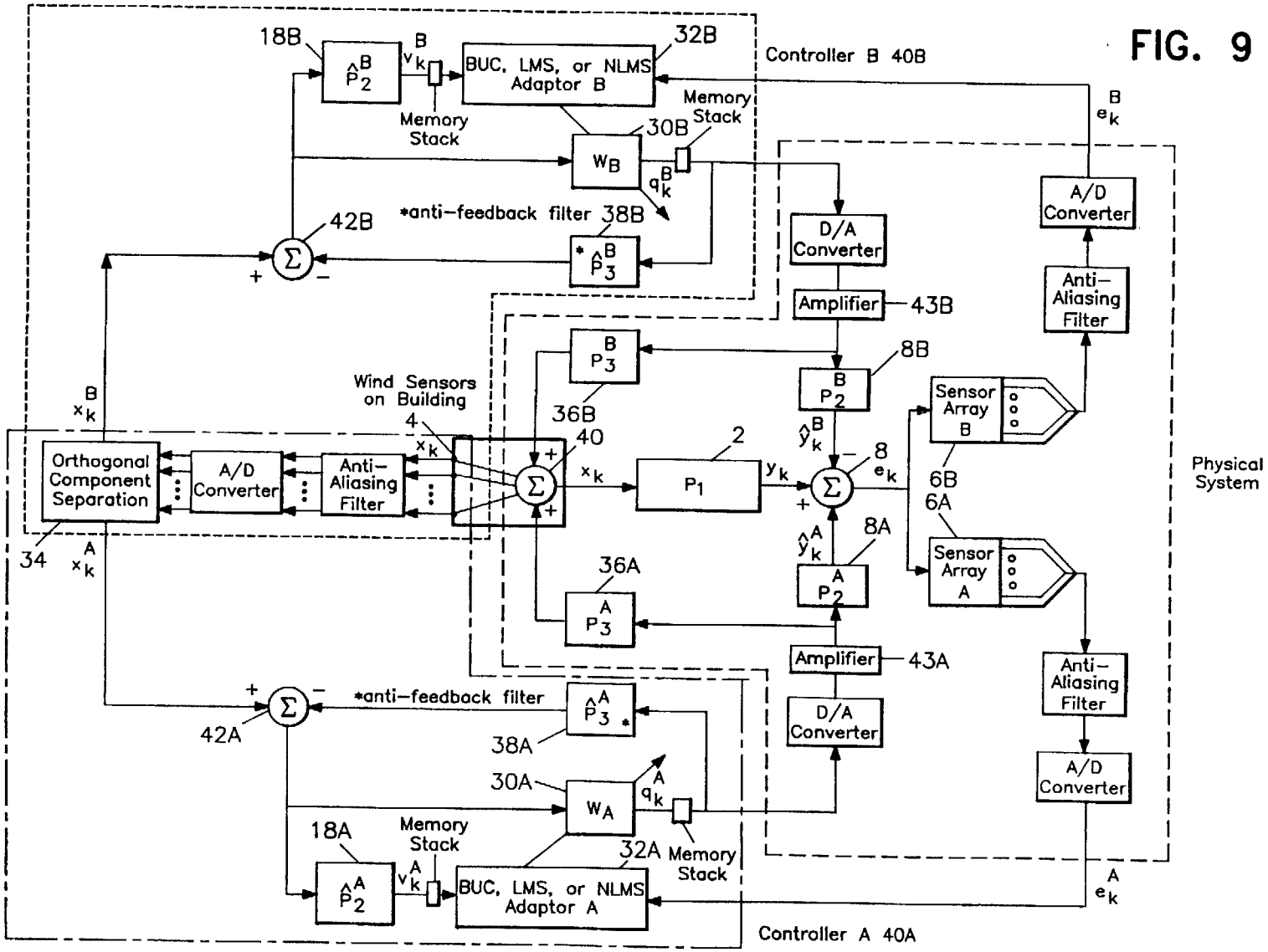
FIG. 9 is a block diagram of the preferred embodiment of the control system for wind disturbances in accordance with the invention.

FIG. 5B shows the preferred embodiment for a multi-dimensional dual controller to counter a wind disturbance to a structure. In FIG. 5B, the upstream sensor array 4 consists of four detectors located at each corner of an upper floor of the building and extending from poles 50. These upstream sensors may be hot wire anemometers. If the sensors provide instantaneous velocity (including direction) then only four sensors are required. Such sensors are well known and, if used, the detected disturbance data is then decomposed into orthogonal components by the digital signal processor 34 as schematically shown in FIG. 9. If the sensors provide only instantaneous speed, then at least eight sensors would be required to determine the direction as in the earthquake configuration.

The wind sensors need to be far enough away from the building to allow for the controller delay. For wind with a speed of 60 miles per hour (88 ft/sec), sampled at 500 Hz, a three sample delay would require that the sensors be a minimum of 0.006 sec×88 ft/sec=0.528 ft from the building. The sensors may have a few millisecond delay which must be accounted for, thus if the poles are four to five feet long the delay requirement is more than satisfied.

In both FIGS. 5A and 5B, there are two downstream sensor actuator arrays 6A and 6B on adjacent, orthogonal sides of the building. The countering force apparatus 8 may be located in a center chamber room 22 on an upper floor or roof 24 of the building. The walls of the center chamber must be an integral part of the structural supports of the building. For example, the chamber could be designed for the space between dual elevator shafts, thus allowing the use of the window sides of the building for offices.

Figure 6A:
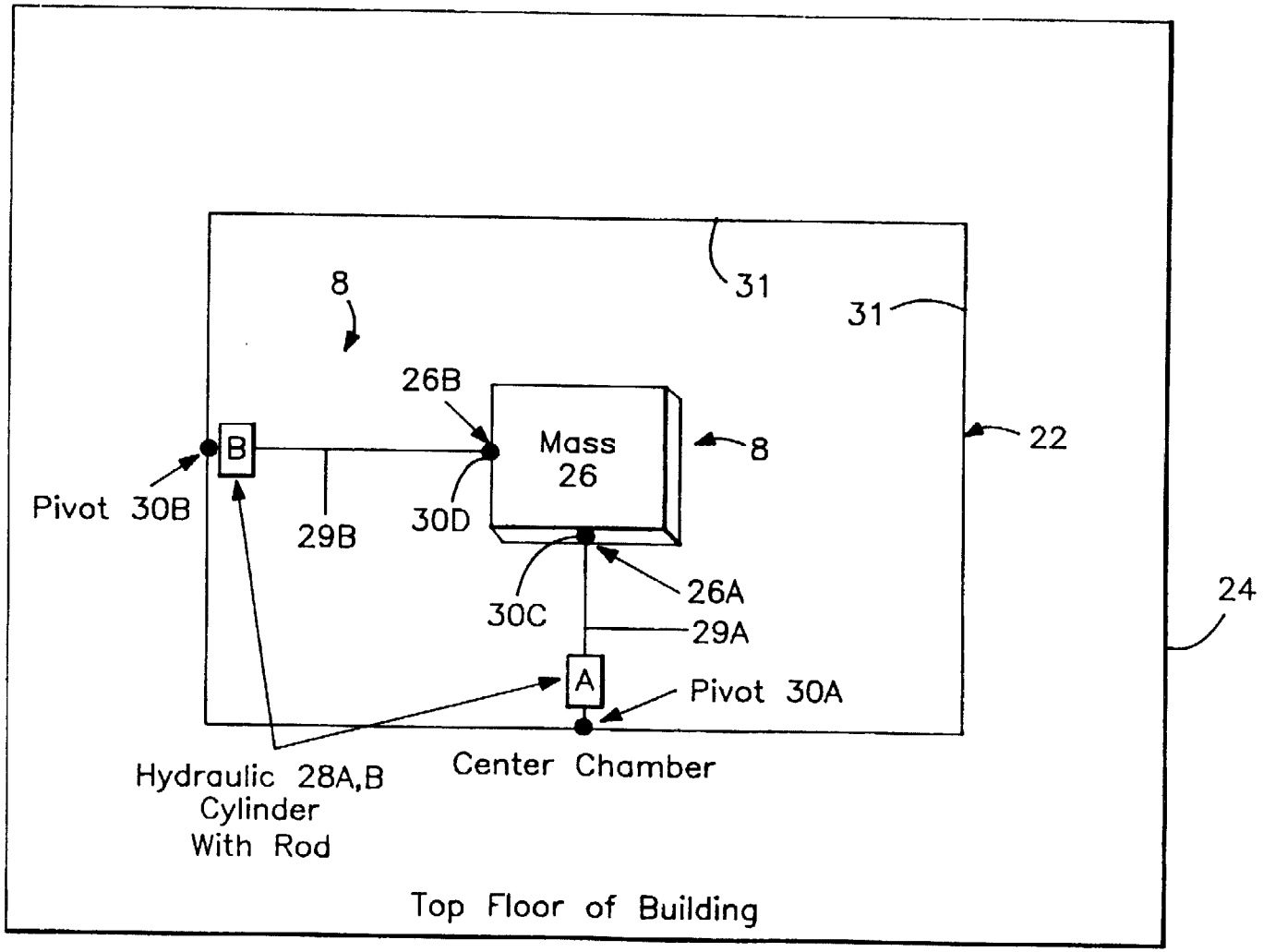
FIG. 6A is a top view schematic of the control system's controlling force apparatus for a seismic or wind disturbance to a building in accordance with the invention.
Figure 6B:
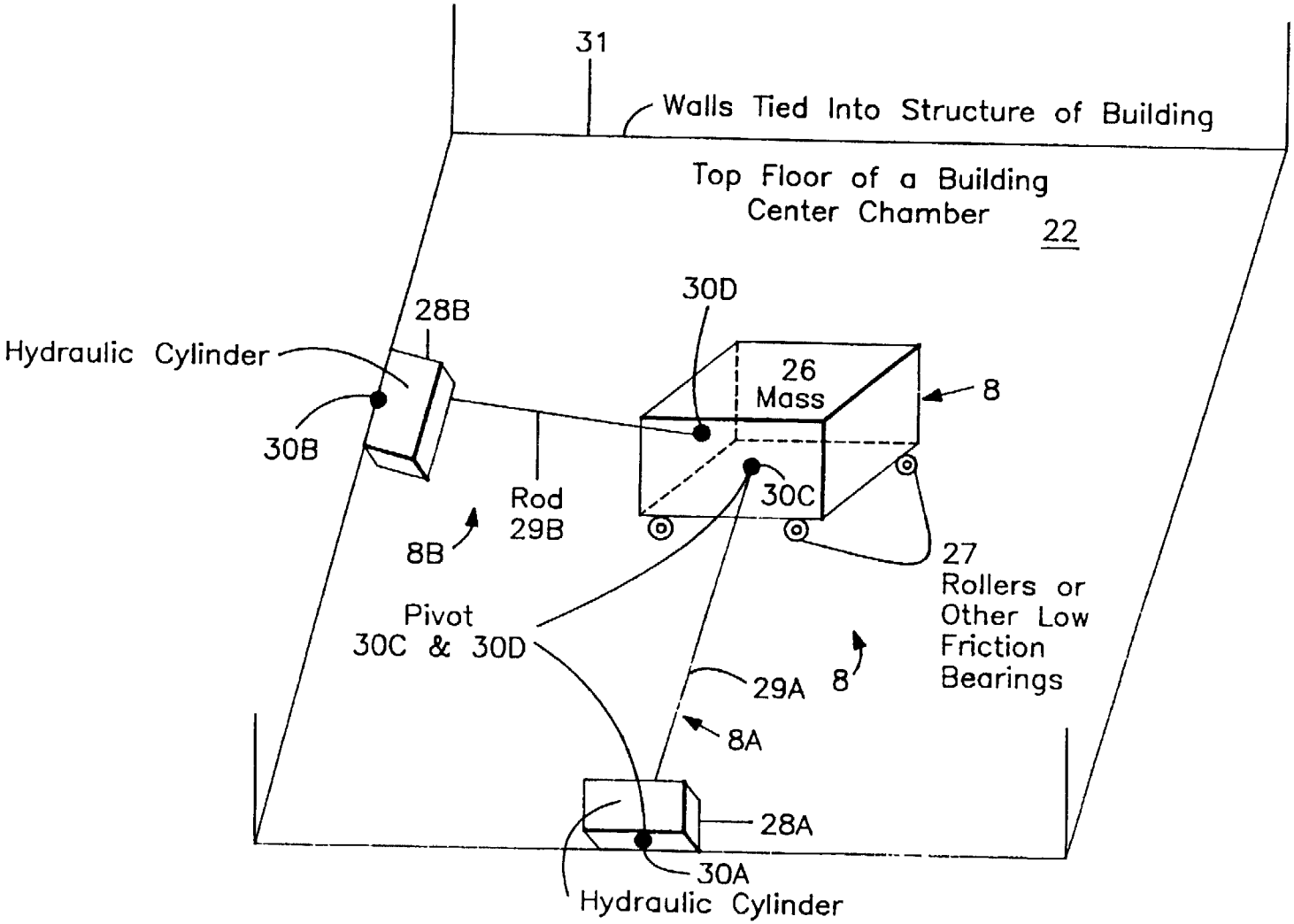
FIG. 6B is a perspective view of the control system's controlling force apparatus for a seismic or wind disturbance to a building in accordance with the invention.
Figure 10:
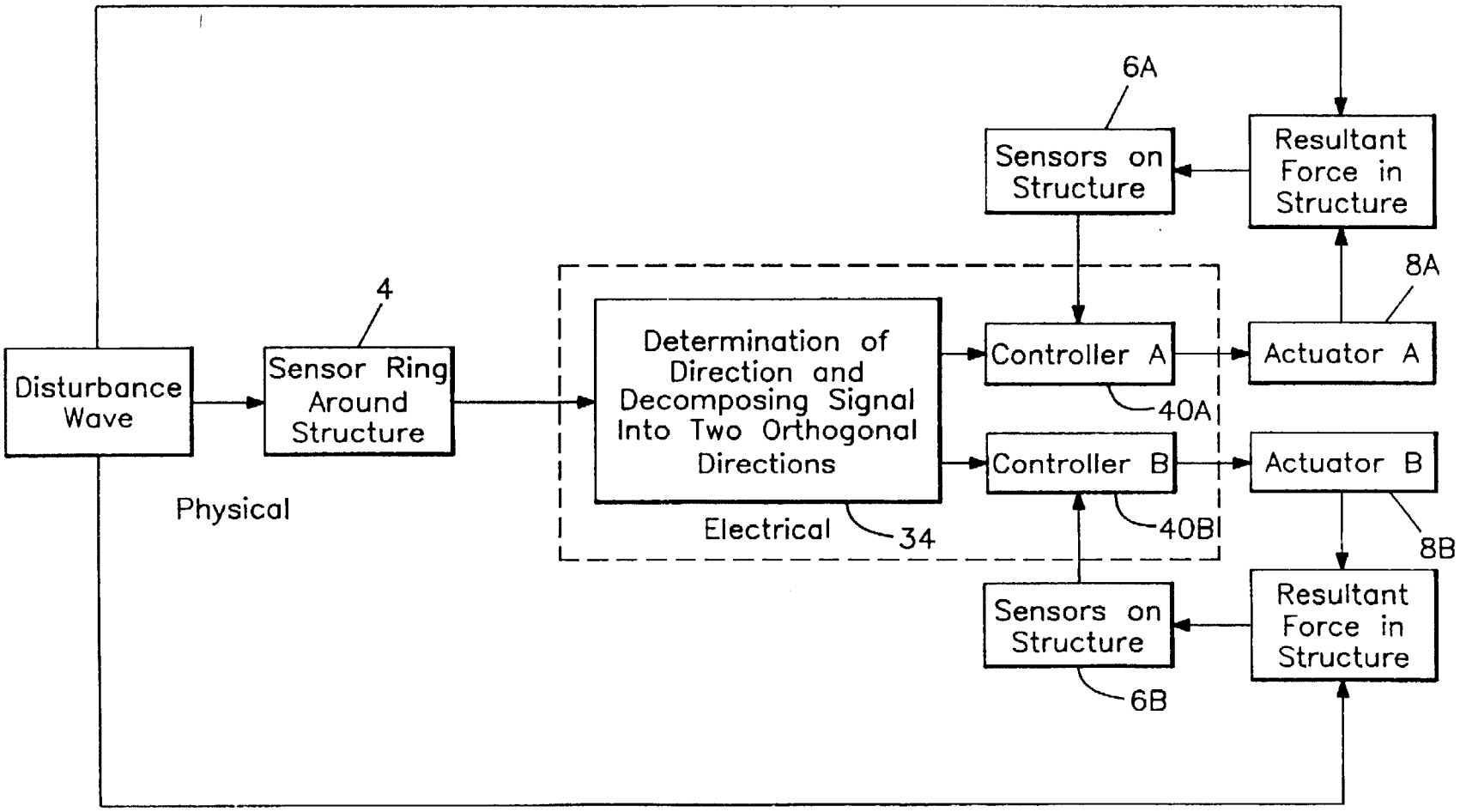
FIG. 10 is a block diagram of the connections between the physical system and the electrical controller.

The countering force apparatus 8, as depicted in FIGS. 6A and 6B, includes mass 26 on rollers 27 or other low friction bearings and two orthogonally oriented hydraulic cylinders 28A,28B, or other type actuator, each having a movable piston (not shown) connected to stiff actuator rods 29A–B. Each hydraulic cylinder is controlled by a separate controller 40A,40B (as schematically shown in FIGS. 8, 9, and 10) in a manner to be described. The hydraulic cylinders or other type actuator with rods 29A–B are pivotally attached to the structural support of the building, such as to walls 31 tied into, or integral with, the structural support of the building, at adjacent, orthogonal sides of the chamber 22 and also pivotally connected to the mass 26 at the corresponding adjacent, orthogonal sides 26A,26B of the mass through pivots 30C,D. Pivots at all four junctions, 30A–B, 30C–D allow the mass to move freely within the confines of the chamber.

Figure 7:
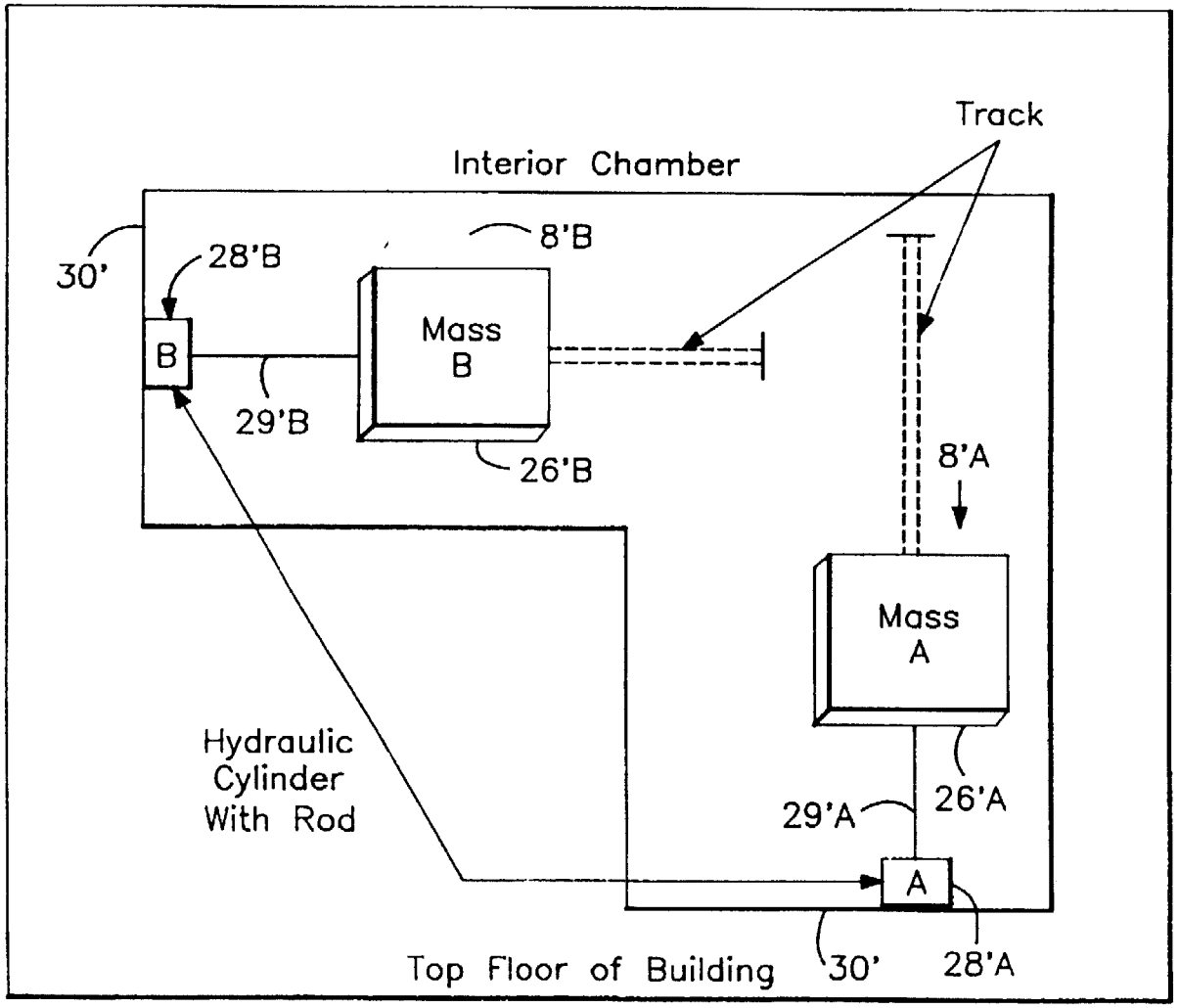
FIG. 7 is a top view of a control system's alternative controlling force apparatus for a seismic or wind disturbance to a building in accordance with the invention.

An alternative countering force apparatus 8' is shown in FIG. 7. The dual mass countering force apparatus 8' includes two independent mass blocks 26A',26B' on rollers or other low friction base for movement along orthogonally oriented tracks. The hydraulic cylinders 28A',28B' or other type actuators, include stiff actuator rods 29A'–B' each controlled by a separate controller 40A,40B in the same manner as schematically shown in FIGS. 8, 9, and 10, as will be described. The hydraulic cylinders or other type actuator with rods 29A'–B' are attached to the structural support of the building at adjacent, orthogonal walls 30 of the chamber and to the appropriate mass 26A',26B' so that the mass may move freely along the straight track within the confines of the chamber. In this embodiment, the cylinders 28A',28B' are not pivotally connected to the walls 30', nor is there a need for pivotal connections with the two masses.

The size of the chamber and the mass (or pair of masses) are related to the force required to counter the maximum disturbance expected as defined by Newton's Law. Newton's law is F=ma, where F is the force imparted to the building by the disturbance, m is the mass of the block or blocks in the chamber and a is the acceleration of the mass which is related to the displacement of the mass. The maximum expected displacement (size of the chamber) and the mass of the block or blocks (maximum mass allowable is determined by the strength of the structures vertical supports) may be traded off based on the maximum force, $F_{max}$, expected. The size of the reaction mass/masses in the upper part of the building is determined by the tradeoff of three constraints.

1) The minimum power requirements are for a large mass. The apparent power of a reaction mass device is $$P=\frac{F^2}{i\omega m}$$

where

P=power

F=force

ω=frequency in radians m=mass

2) The minimum displacement requirements are for a large mass. The displacement for a reaction mass device is $$X=\frac{F}{-m\omega^2}$$

where

X=displacement from equilibrium.

A small displacement means less area of the building must be given up for the chamber room.

3) The minimum structural requirements to support the mass are for a small mass. A successful design will balance these three constraints.

FIG. 8 is a block diagram of the multi-dimensional dual orthogonal control system in accordance with the invention for a seismic disturbance. FIG. 9 is a block diagram of the multi-dimensional dual orthogonal control system in accordance with the invention for a wind disturbance. Like reference numerals are used from FIGS. 1–7 to facilitate clarity. As illustrated in these FIGS. 8 and 9, the output of each of the dual orthogonal controllers 40A,40B is a digital electrical signal over lines 41A,41B which is converted to an analog signal which drives a power amplifier 43A,43B. The amplifier output controls a servo valve on the hydraulic cylinder of the actuator in a manner well known in the art. Thus, the electrical output signal from each of the dual controllers controls the amount of fluid flow into and out of the cylinder and the force exerted on the reaction mass and into the building.

With reference to FIG. 8, the control system includes dual controllers 40A,40B, each based on time domain feed forward FIR filters adapted by the BUC, LMS, or NLMS to provide a cancellation signal to attenuate or counter the vibrational disturbance. Because seismic or earthquake waves are of a combined broadband and narrowband character, the BUC algorithm is preferred in the adaptive filter. When the input is high winds, which is generally not of combined character but rather, a narrowband character input, then the LMS or NLMS may be utilized.

The sensors 4 detect the incoming seismic disturbance in advance of the disturbance propagation through the structure 2. When the disturbance reaches the structure, the structure 2, defined by the transfer function $P_1$ produces the structural response $y_k$. The various sensors include transducers to detect the disturbance and convert the disturbance into electrical signals which are anti-aliased and converted to digital format and then are input into an orthogonal component separator 34 which may be a digital signal processor. The processor determines which of the sensors should be looked at, in the manner as discussed above, and then separates the input or reference signal into orthogonal components $x_k^A$, $x_k^B$. The orthogonality is predetermined with respect to the orthogonal components, or sides, of the building structure.

The orthogonal input or reference signals are provided to corresponding orthogonal feed forward controllers 40A, 40B. In the depicted embodiments, the input signal is divided into two orthogonal components and the dual controllers are provided. If the input is broken down into more than two components, or if more than two orthogonal sets of actuators are utilized, then more than two controllers are required.

The appropriate orthogonal component of the input signal is then fed into a pre-filter 18A,18B which filters the input with a predetermined stationary estimate of the appropriate orthogonal component of the actuator response transfer function $\hat{P}_2$, ($\hat{P}_2^A$, $\hat{P}_2^B$) to obtain signal $v_k$ ($v_k^A$, $v_k^B$), which is then used in conjunction with the appropriate orthogonal component of the error $e_k$, ($e_k^A$, $e_k^B$) in the BUC, LMS, or NLMS to adjust the weights. (For the BUC algorithm, a memory stack is required, as will be discussed.) The determination of the estimated transfer function between the actuators and the output sensors may be determined by experimentally driving the building with the respective orthogonal actuators and measuring its response, or by mathematical modeling using a finite element model, both techniques being well known.

The filtered orthogonal reference signal component from 18A,18B, is then input into the adapter, or filter weight adjustment means, 32A,32B, along with the respective orthogonal error or output signals $e_k^A$, $e_k^B$, whereby the filter weights (or coefficients) are adjusted in accordance with the selected mathematical algorithm. The weight vectors, $w^A$ and $w^B$ are then used to filter 30A,30B, the appropriate orthogonal component of the input signal and the output $q_k$, after conversion to analog output and amplified by amplifier 43A,43B comprises the orthogonal actuator driving signal. This signal actuates the actuators. The actuators impart a cancellation vibration field to the structure 2, modified by the appropriate transfer function $P_2$, ($P_2^A$, $P_2^B$), 8A,8B to produce the cancellation vibration. This signal is summed with the signal $y_k$, ($y_k^A$, $y_k^B$) within the structure and the resulting or combined effect of the input and cancellation field signals is sensed as the error. The orthogonal components of the error signal $e_k$, ($e_k^A$, $e_k^B$) are then fed correspondingly into the two different controllers A and B 40A, 40B, by way of the BUC, LMS, or NLMS adapters 32A, 32B. The appropriate component of the error signal, ($e_k^A$, $e_k^B$), after anti-aliasing and conversion to digital format, is used in the corresponding adaptive algorithm to update the filter weights and provide a better cancellation signal. The system adapts its response to the input signal to cancel vibrations by minimizing the error signal.

For the case of the wind disturbance to the building, FIG. 5B, the only difference in the physical system from the seismic case is a change in the upstream sensor array 4 and its location, as well as the use of a feedback filter. The upstream sensor array, consisting of wind sensors which measure the wind velocity, must be located in the air stream about the building 2. This can be accomplished by locating the sensors on poles 50 off the corners of an upper floor of the building, as previously discussed. The wind stream velocity decreases as it gets closer to the ground according to a known prescribed formula. This information can be used to better adapt to the disturbance. The wind velocity is measured by the upstream sensors 4 and the wind profile derived to provide the input signal, $x_k$, that causes the disturbance to the building. Like the seismic case, the downstream sensors 6 on orthogonal sides of the building measure the response and the orthogonal controllers determine the appropriate canceling force. Because the upstream sensors 4 are located on the building they will be contaminated by the controlling force applied to the building. That is, the cancellation vibration field applied by the actuators will be fed back and detected by the input sensors attached to the building. This feedback path must be compensated for.

The transfer function between the apparatus applying the cancellation force 8 and the upstream sensors 4 is given by $P_3$ ($P_3^A$, $P_3^B$). In order to compensate for the feedback path represented by $P_3$, the transfer function between the actuators and the upstream sensors, the controller must have an anti-feedback filter, $\hat{P}_3$. The main differences between FIG. 8 and FIG. 9 are with the predetermined stationary anti-feedback filters $\hat{P}_3^A$ and $P_3^B$ 38A,38B to compensate for the contamination of the upstream sensors 4 as defined by $P_3$ 36A,36B and the summation of the cancellation signal with the input signal at 40 to give the contaminated signal. The orthogonal cancellation signals are fed into the appropriate anti-feedback filter $\hat{P}_3^A$ and $\hat{P}_3^B$ 38A,38B and then subtracted at 42A,42B with the input signal that is contaminated with feedback (as shown at 40). Note that the contamination signal that is summed with the input is within the physical system. As such it is an analog signal depicted as is shown in FIG. 9 as coming from the analog cancellation signal to be input 40.

FIG. 10 shows a block diagram of the connections between the physical and electrical systems of this invention. The controller can be thought of as having three parts and three interconnections between the sensors and the actuators as shown in FIG. 10. The first part of the controller is the sensor ring around the structure (or the wind sensors on poles) with the part that determines the direction of arrival and decomposition of the earthquake signal into the spatially orthogonal components by the separator 34. Then the two orthogonal input signals which are generated by the first part of the system are the inputs to the two adaptive controller channels 40A,40B. The input to the two adaptive controllers are the sensors from the building which are spatially orthogonal to each other. The sensors on the building detect the motion of the structure. It is the controllers' function to drive the building motion to a minimum by providing signals to the two spatially orthogonal actuators 8A,8B in the structure. The resultant building motion from the input vibration field of the disturbance wave and the cancellation vibration field from the actuator array is detected by the orthogonally oriented output sensors 6A,6B.

The digital signal processing configuration of the controller would consist of three DSP boards. The first DSP board would be for the A/D and D/A converters (for example, the ICS 140), the second board would provide the anti-aliasing filters and the last board would be a multiple programmable chip board such as the four chip Pentek DSP board. On this last board, two chips would be programmed as the orthogonal separator for the input and two other chips would be programmed as the dual orthogonal controllers.

The invention proposed for both embodiments updates the filter weights with the BUC, LMS or NLMS depending on the type of signal expected. Implementation of the LMS and NLMS into the control configuration as the adaptive algorithm is direct, requires no modification, and is well known in the controller art. When employing the BUC for multiple tonal signals or combined broadband/narrowband signals, such as is expected for earthquake disturbances, the updates are determined based on a number of past values equal to a small percentage of the length of the filter. The present invention enables the use of the known BUC to provide an adjustment to a control actuator which is responsive for both narrowband and/or broadband spectrum signals in a stable feed forward FIR-based control system that is computationally feasible (i.e., L small).

When the controller is based on the BUC adaptive algorithm, the controller has memory capability, (i.e., use of multiple past values of the input) as shown in FIGS. 8 and 9. Thus a modification must be made to initialize the BUC and fill the memory stacks. Both $v_k$ and $q_k$ memory stacks are required, whose lengths are dependent on the number of weights used, N, the amount of memory to be used for the determination of the weights, L, and the length of the filter $P_2$, M. Note that the $q_k$ memory stack is required for $q_k$ to be filtered by $P_2$. In a real system $P_2$ represents the transfer function between the actuator input and the downstream sensors. $P_2$ is not known a priori. The $q_k$ memory stack represents the delay of $P_2$. In the real system $q_k$ is applied via the actuator and the $e_k$ is sensed. The q memory stack which represents the delay of $P_2$ and $P_2$ as a filter are for illustration purposes only. Each time a memory stack is updated the most recent value is added to the top of the stack and the oldest is removed from the bottom of the stack. For example at time k for k>max(M,N,2L−1), the BUC uses 2L−1 past values of a signal v so k−2L+1 values are in storage for use in the algorithm. At each time k, the newest value of v, $v_k$, is saved at the top of the stack pushing the other values down the stack, with the oldest value, $v_{k-2L}$ discarded.

The BUC computes the N weights at time k, $w_{N,k}$, by the equation:

$$w_{N,k} = w_{N,k-J} + \frac{1}{1+\mu_k} e_{L,k} R_{L,N,k}^{-1} V_{N,L,k} \tag{1}$$

where

N=the length of the FIR filter (number of weights) used in the controller

L=the size estimate to the sample covariance matrix

J=the sample advance per time step

M=the length of the filter $P_2$ $x_k$=is the input signal value from the upstream sensor at time k $v_k$=is the input signal value to the BUC at time k $y_k$=is the output signal values from the downstream sensors at time k $q_k$=is the output value of the BUC into the physical system $\hat{y}_k$=is the estimate to $y_k$ in the physical system $\mu_k$=is the convergence parameter at time k $y_{L,k}=[y_k \cdot \cdot \cdot y_{k-N+1}]^H$ $$v_k = \sum_{i=0}^{M} \hat{P}_2(i)\, x_{k-i}$$

$$q_{L,k} = [q_k \cdots q_{k-N+1}]^H$$

$$\hat{y}_{L,k} = [\hat{y}_k \cdots \hat{y}_{k-N+1}]^H$$

-continued $$X_{N,L,k} = \begin{bmatrix} x_k^H & \cdots & x_{k-N+1}^H \\ \vdots & \ddots & \vdots \\ x_{k-L+1}^H & \cdots & x_{k-N-l+2}^H \end{bmatrix}$$

$$V_{N,L,k} = \begin{bmatrix} v_k^H & \cdots & v_{k-N+1}^H \\ \vdots & \ddots & \vdots \\ v_{k-L+1}^H & \cdots & v_{k-N-l+2}^H \end{bmatrix}$$

$$R_{L,N,k} = V_{L,N,k} V_{L,N,K}^H$$

$R_{L,N,k}^{-1}\, V_{L,N,K}$ is found using Levinson's recursion $$q_{L,k} = X_{N,L,K} w_{N,k-L}^H$$

$$\hat{y}_k = \sum_{i=0}^{M} P_2(i)\, q_{k-i}$$

$$e_{L,k} = y_{L,k} - \hat{y}_{L,k}$$

(These equations occur only in simulation. Within the physical system the error is sensed.)

The value of μ may vary with time depending on the problem to be solved. It is usually taken to be greater than or equal to zero (See, Slock article, discussed above and incorporated herein). The value of μ determines how much of a correction is made to the previous set of weights to determine the new weight vector. If μ is set equal to 1 then ½ of the correction value $e_{L,k} R_{1,N,K}^{-1} V_{N,1,K}$ is used to compute $w_{N,k}$ from $w_{N,k-j}$ in Eq. 1. The weights are then used to filter input data using $x_k$ through $x_{k-n+1}$ to give $q_k$. The $q_j$ (j=k−M+1 to k) fill a memory stack of length M. The $q_j$ (j=k−M+1 to k) are filtered by the M length filter $P_2$ to give $\hat{y}_k$, the canceling signal to be applied. (This equation occurs only in simulation because $P_2$ represents the physical system. The value $q_k$ enters the D/A converter and amplifier, then enters the system.)

Since the $v_k$ memory stack is not full during the initialization, the BUC is modified to accommodate this lack of information. During the initialization of the controller which occurs for k<max(M,N,2L−1) equation (1) is modified with L=1 as follows $$w_{N,k} = w_{N,k-1} + \frac{1}{1+\mu_k} e_{1,k} R_{1,N,k}^{-1} V_{N,1,k}. \tag{2}$$

Figure 11:
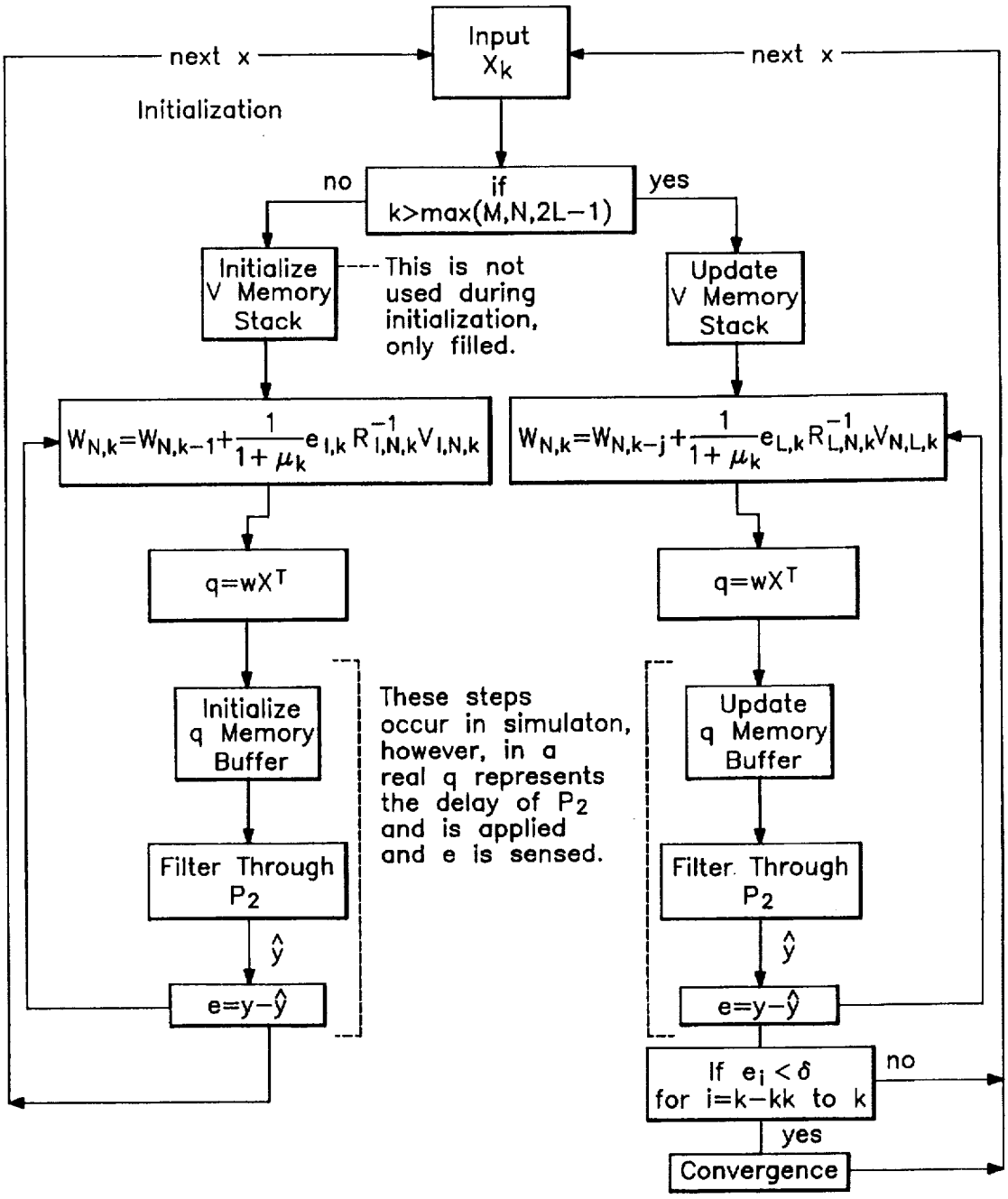
FIG. 11 is a flowchart of the BUC controller with initialization modifications.

FIG. 11 shows a flow chart of the controller algorithm with initialization. Notice that the initialization branch has a memory buffer for $v_k$ and $q_k$ which require initialization. The $v_k$ stack is not used during initialization only filled. Note that the q buffer is initially zero and the zeros are pushed off the stack by the newest q value.

Figure 12A:
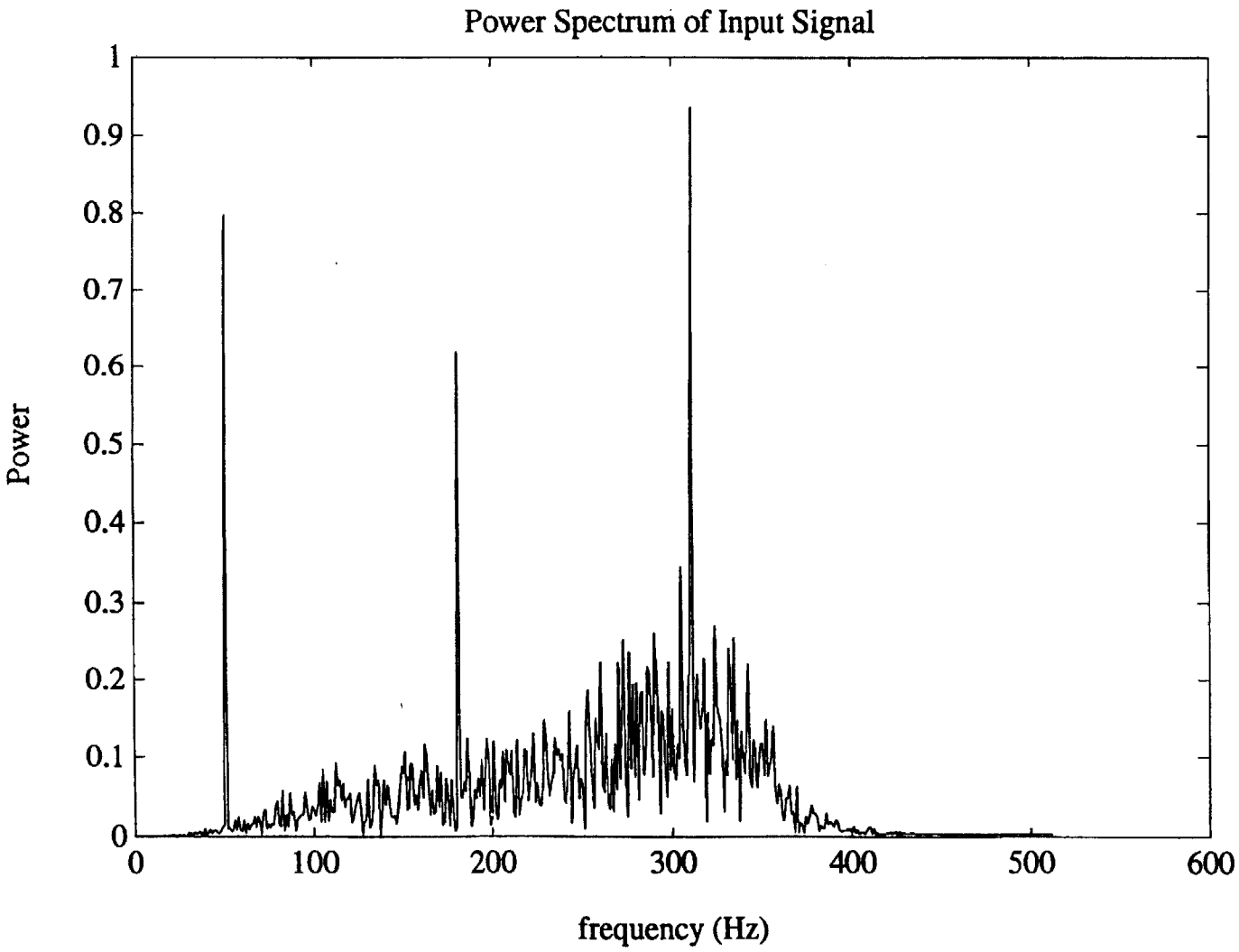
FIG. 12A is the power spectrum of a combined input signal.
Figure 12B:
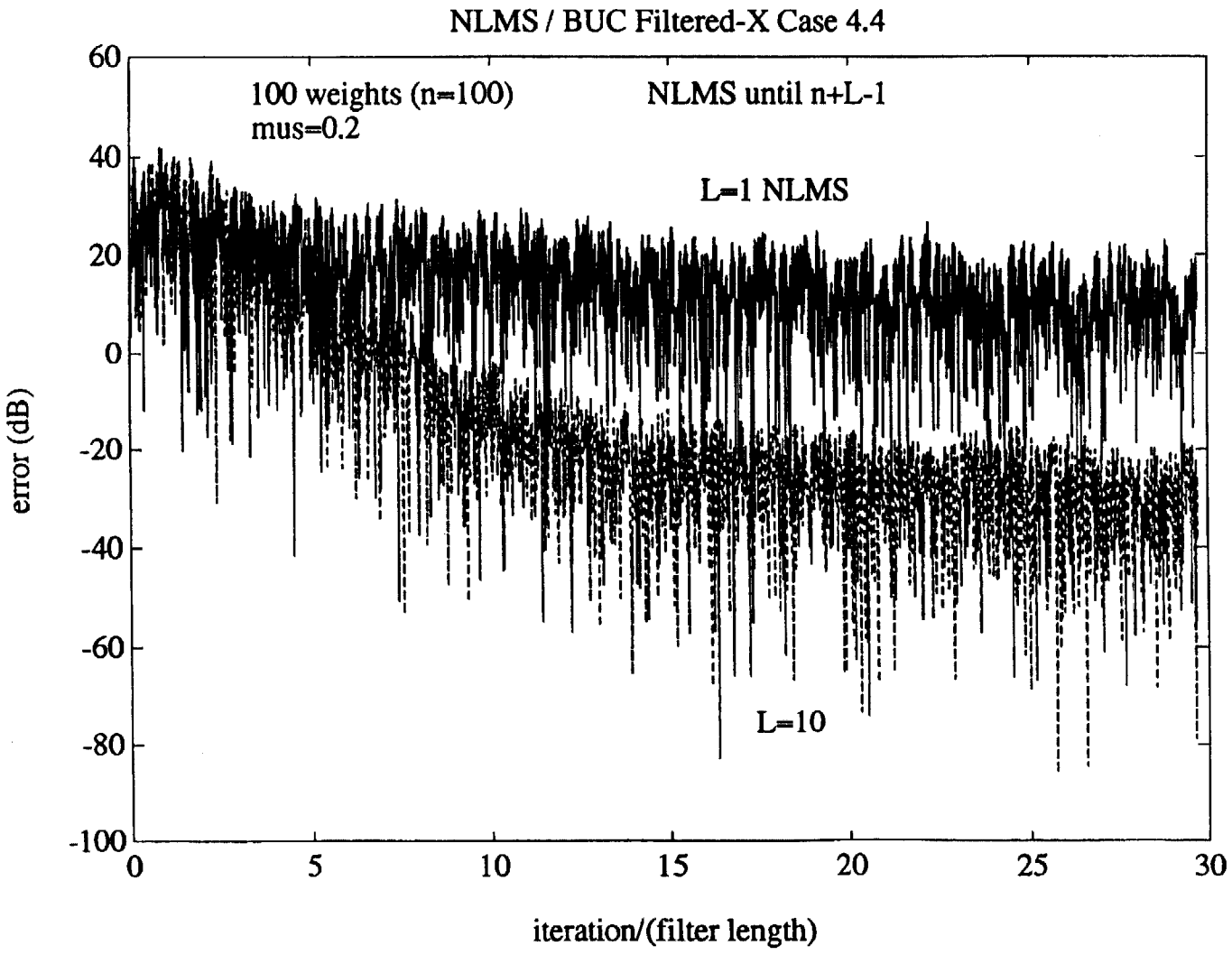
FIG. 12B is a comparison of the convergence results from LMS and BUC based controllers for combined input.
Figure 12C:
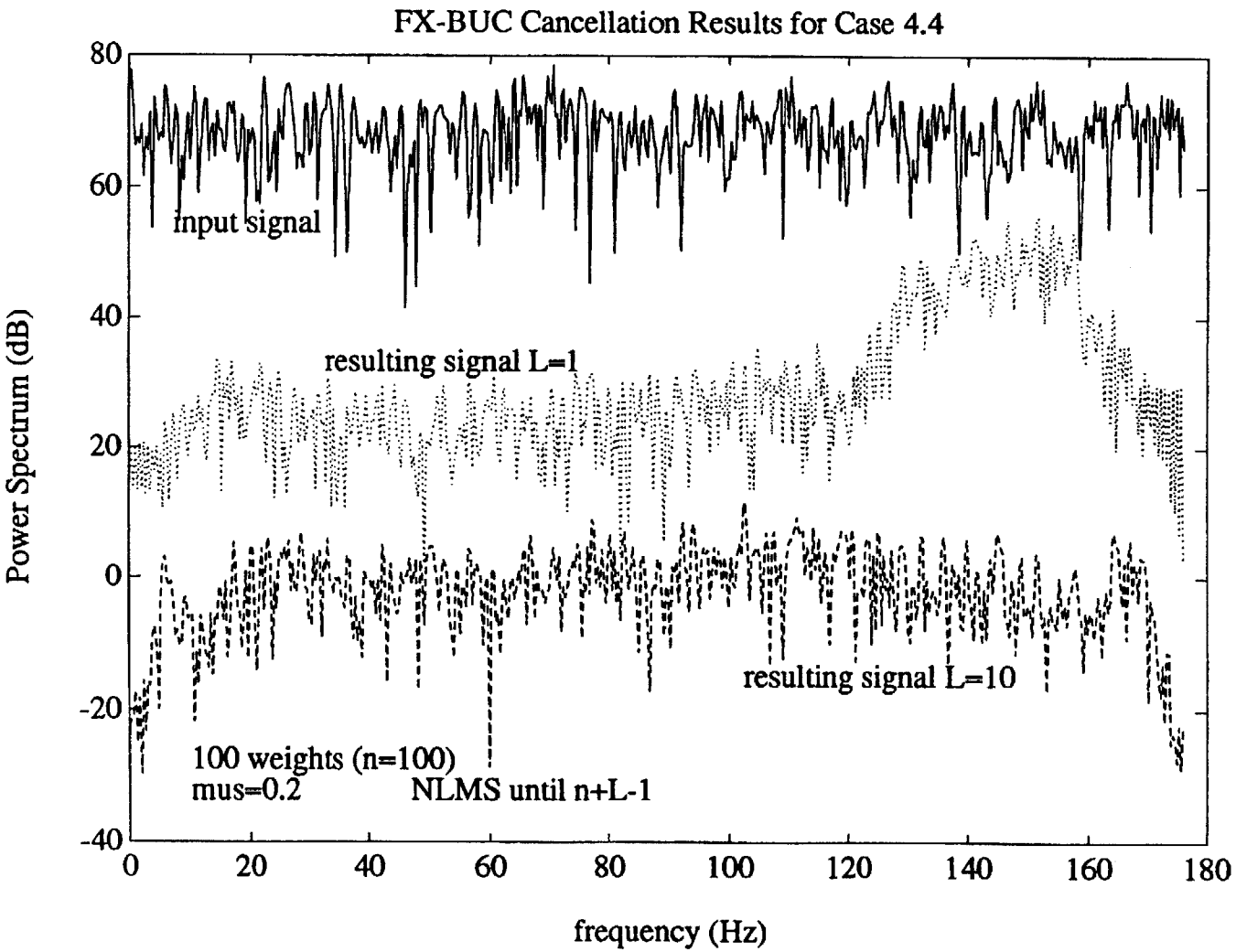
FIG. 12C is a comparison of the output power spectra from LMS and BUC based controllers.

FIG. 12A shows the spectrum of a combined input signal. FIG. 12B shows the error output signal for a simulated problem using this combined input for an NLMS based controller and a BUC based controller. In a perfect system, when the output error signal is exactly zero, the controller is providing total disturbance control. Notice that the BUC based controller with L=10 for N=100 provides attenuation (error to −15 and −35 dB) whereas the NLMS based controller developed by Burgess has difficulty converging to 0 dB in this case. In addition, convergence occurs within 10 to 15 filter lengths for our invention. FIG. 12*c* shows the power spectra of the input signal and the output error signal for the NLMS based controller and for the BUC based controller with L=10. Notice that the BUC based controller outperforms the filtered-X NLMS controller across the entire frequency range but particularly at the higher frequencies. Note that the NLMS performs very well for the single tonal, harmonic tonals, or the strictly broadband problem, and for those cases it is appropriate to use the LMS or NLMS in the controller. However, for other kinds of problems, the BUC is a better alternative.

While this invention has been described in terms of a number of preferred embodiments, those skilled in the art will recognize that various equivalents, alternatives and modifications are possible within the scope of the appended claims. It is assumed that anyone skilled in the art of digital controllers understands that all signals to and from the controller would be anti-aliased and converted from analog to digital (A/D) or digital to analog (D/A) as appropriate and thus these steps are not shown or discussed.

What is claimed is:

1. An active vibration control system for attenuating an input vibration field within a building structure resulting from externally applied, seismic or other environmentally induced, disturbances acting upon the building structure, the control system comprising:

a plurality of input sensors positionable about a building structure for sensing incoming disturbances in advance of the disturbances reaching the building structure and for converting such sensed disturbances to a reference signal;

orthogonal component separation means for receiving the reference signal and converting the reference signal into orthogonal reference signal components;

a plurality of output sensors positionable on a building structure for sensing building structure vibrations and for converting such sensed vibrations to orthogonal output signals;

vibration actuator means for imparting a cancellation vibration field to a building structure so as to counteract said input vibration field and to reduce building structure vibrations, said vibration actuator means including orthogonally oriented actuators responsive to orthogonal actuator driving signals;

plural orthogonal feed forward controller means for receiving said orthogonal reference signal components and said orthogonal output signals and for providing orthogonal actuator driving signals to said vibration actuator means, said plural orthogonal feed forward controller means comprising a plurality of feed forward controllers corresponding in number to the number of orthogonal reference signal components, each controller comprising:

first controller input means for receiving one of said orthogonal reference signal components;

second controller input means for receiving a corresponding orthogonal output signal;

digital signal processing means for response to said orthogonal reference signal component and said orthogonal output signal and for providing an orthogonal actuator driving signal to said vibration actuator means so as to drive said orthogonally oriented actuators to impart a cancellation vibration field to the building structure to counteract said input vibration field.

2. The active vibration control system of claim 1, wherein said digital signal processing means of each feed forward controller comprises adaptive finite impulse response (FIR) filter means for filtering the orthogonal reference signal component to produce said orthogonal actuator driving signal.

3. The active vibration control system of claim 2, wherein said digital signal processing means of each feed forward controller further comprises FIR filter weight adjustment means for response to said orthogonal reference signal component and said orthogonal output signal and for adjusting filter weights of said FIR filter means.

4. The active vibration control system of claim 3, wherein said digital signal processing means of each feed forward controller further comprises:

pre-filter means for filtering said orthogonal reference signal component with an estimate of the orthogonal component of a transfer function between said vibration actuator means and the output sensors and for providing said filtered orthogonal reference signal component to said FIR filter weight adjustment means.

5. The active vibration control system of claim 4, wherein said FIR filter weight adjustment means includes means for adjusting the FIR filter weights in accordance with the least mean square (LMS) algorithm.

6. The active vibration control system of claim 4, wherein said FIR filter weight adjustment means includes means for adjusting the FIR filter weights in accordance with the Block Underdetermined Covariance (BUC) algorithm.

7. The active vibration control system of claim 1, wherein said plurality of output sensors comprise two sets of plural output sensors each set being positionable on adjacent orthogonal sides of a building structure and remote from any vibrational node of the first three modes of the building structure.

8. The active vibration control system of claim 1, wherein said vibration actuator means includes means for counteracting the input vibrations of the first three modes of the building structure.

9. The active vibration control system of claim 1, wherein said vibration actuator means further comprises a movable mass, said movable mass positionable within an upper level of a building structure, and connecting means for connecting orthogonal portions of said movable mass with said respective orthogonally oriented actuators.

10. The active vibration control system of claim 9, wherein said movable mass is locatable within a substantially central chamber within the building structure and said orthogonally oriented actuators are connectable between said movable mass and a structural support of the building structure so that the movable mass is movable with respect to said structural support.

11. The active vibration control system of claim 10, wherein each of said orthogonally oriented actuators includes a hydraulic actuator having a hydraulic piston connected to an actuator rod, said actuator rod pivotally connected to said movable mass, said hydraulic actuator physically securable with respect to said structural support.

12. The active vibration control system of claim 1, for attenuating vibrations resulting from incoming wind waves, wherein said plurality of input sensors are positionable adjacent an upper level of a building structure so as to detect wind waves in advance of their reaching the building structure and to detect feedback vibrations resulting from the cancellation vibration field imparted by said vibration actuator means and for converting such detected wind waves and feedback vibrations to said reference signal.

13. The active vibration control system of claim 12, wherein each of said feed forward controllers comprises feedback compensation means for adjusting said orthogonal reference signal component to compensate for the cancellation vibration field, and for producing an adjusted orthogonal reference signal component.

14. The active vibration control system of claim 13, wherein said digital signal processing means of each feed forward controller comprises adaptive finite impulse response (FIR) filter means for filtering the adjusted orthogonal reference signal component to produce said orthogonal actuator driving signal.

15. The active vibration control system of claim 14, wherein said feedback compensation means comprises feedback filter means for filtering said orthogonal actuator driving signal with an estimate of the orthogonal component of a transfer function of a feedback path between said vibration actuator means and said input sensors.

16. An adaptive orthogonal feed forward control system for reducing disturbances acting upon a physical structure, the control system comprising:

input sensor means for sensing disturbances applied to a structure and for converting the sensed disturbances to a reference signal;

orthogonal component separation means for receiving the reference signal and converting the reference signal into orthogonal reference signal components;

actuator means for applying a cancellation field to the structure to counteract the disturbances;

output sensor means positionable on the structure and downstream from said actuator means for sensing a resultant combined effect of the disturbances and the applied cancellation field and for providing orthogonal output signals corresponding thereto;

orthogonal feed forward controller means for receiving the orthogonal reference signal components and the orthogonal output signals and for providing orthogonal actuator driving signals to said actuator means, said orthogonal feed forward controller means comprising plural feed forward controllers corresponding to the number of orthogonal reference signal components, each controller comprising, first controller input means for receiving one of said orthogonal reference signal components;

second controller input means for receiving a corresponding orthogonal output signal;

digital signal processing means for response to said orthogonal reference signal component and said orthogonal output signal and providing an orthogonal actuator driving signal to said actuator means so as to drive said actuator means and to impart a cancellation field to the structure to counteract the disturbances.

17. The orthogonal feed forward control system of claim 16, wherein said digital signal processing means of each feed forward controller comprises adaptive finite impulse response (FIR) filter means for filtering the orthogonal reference signal component to produce said orthogonal actuator driving signal.

18. The orthogonal feed forward control system of claim 17, wherein said digital signal processing means of each feed forward controller further comprises FIR filter weight adjustment means for response to said orthogonal reference signal component and said orthogonal output signal and for adjusting filter weights of said FIR filter means.

19. The orthogonal feed forward control system of claim 18, wherein said digital signal processing means of each feed forward controller further comprises:

pre-filter means for filtering said orthogonal reference signal component with an estimate of the orthogonal component of a transfer function between said actuator means and the output sensor means and for providing said filtered orthogonal reference signal component to said FIR filter weight adjustment means.

20. The orthogonal feed forward control system of claim 19, wherein said FIR filter weight adjustment means includes means for adjusting the FIR filter weights in accordance with the least mean square (LMS) algorithm.

21. The orthogonal feed forward control system of claim 19, wherein said FIR filter weight adjustment means includes means for adjusting the FIR filter weights in accordance with the Block Underdetermined Covariance (BUC) algorithm.

22. An adaptive feed forward control system for reducing undesirable disturbances acting upon or within a physical structure, the control system comprising:

input sensor means for sensing the disturbances and for converting the sensed disturbances to a reference signal;

actuator means for applying a cancellation signal to counteract the disturbances;

output sensor means for sensing the output resulting from the disturbances and the applied cancellation signal and for providing an output signal corresponding thereto;

adaptive feed forward controller means for receiving the reference signal and output signal and for providing an actuator driving signal to said actuator means, said controller means including adaptive finite impulse response (FIR) filter means for filtering the reference signal to produce the actuator driving signal, and FIR filter weight adjustment means for response to said reference signal and said output signal and for adjusting the FIR filter weights in accordance with the Block Underdetermined Covariance (BUC) algorithm.

23. The adaptive feed forward control system of claim 22, wherein said controller means further comprises pre-filter means for filtering said reference signal with an estimate of a transfer function between said actuator means and said output sensor means and for providing said filtered reference signal to said FIR filter weight adjustment means.

24. The active vibration control system of claim 4, wherein said FIR filter weight adjustment means includes means for adjusting the FIR filter weights in accordance with the normalized least mean square (NLMS) algorithm.

* * * * *